US011078450B2

(12) United States Patent
Norimoto et al.

(10) Patent No.: US 11,078,450 B2
(45) Date of Patent: Aug. 3, 2021

(54) MATERIAL CONTAINING SOLID BLEACHING AGENT, AND DETERGENT COMPOSITION

(71) Applicant: SHIKOKU CHEMICALS CORPORATION, Kagawa (JP)

(72) Inventors: Akihiro Norimoto, Tokushima (JP); Koichi Sahiro, Tokushima (JP); Tsuyoshi Toyota, Tokushima (JP); Yoshiya Iwasaki, Tokushima (JP)

(73) Assignee: SHIKOKU CHEMICALS CORPORATION, Kagawa (JP)

( * ) Notice: Subject to any disclaimer, the term of this patent is extended or adjusted under 35 U.S.C. 154(b) by 102 days.

(21) Appl. No.: 16/095,027

(22) PCT Filed: Apr. 21, 2017

(86) PCT No.: PCT/JP2017/016111
§ 371 (c)(1),
(2) Date: Oct. 19, 2018

(87) PCT Pub. No.: WO2017/183726
PCT Pub. Date: Oct. 26, 2017

(65) Prior Publication Data

US 2019/0153363 A1 May 23, 2019

(30) Foreign Application Priority Data

Apr. 22, 2016 (JP) ..... JP2016-086619

(51) Int. Cl.

| | |
|---|---|
| ***C11D 7/04*** | (2006.01) |
| ***C11D 7/26*** | (2006.01) |
| ***C11D 7/54*** | (2006.01) |
| ***C11D 17/00*** | (2006.01) |
| ***C11D 3/39*** | (2006.01) |
| ***C11D 3/395*** | (2006.01) |
| ***C11D 1/66*** | (2006.01) |
| ***C11D 3/04*** | (2006.01) |
| ***C11D 3/08*** | (2006.01) |
| ***C11D 3/10*** | (2006.01) |
| ***C11D 3/20*** | (2006.01) |
| ***C11D 3/33*** | (2006.01) |

(52) U.S. Cl.
CPC ..... *C11D 17/0039* (2013.01); *C11D 1/66* (2013.01); *C11D 3/044* (2013.01); *C11D 3/08* (2013.01); *C11D 3/10* (2013.01); *C11D 3/2079* (2013.01); *C11D 3/2082* (2013.01); *C11D 3/33* (2013.01); *C11D 3/3902* (2013.01); *C11D 3/3937* (2013.01); *C11D 3/3942* (2013.01); *C11D 3/3945* (2013.01); *C11D 3/3951* (2013.01); *C11D 3/3953* (2013.01); *C11D 3/3955* (2013.01); *C11D 7/265* (2013.01); *C11D 17/0047* (2013.01)

(58) Field of Classification Search
CPC ... C11D 3/3902; C11D 3/3937; C11D 3/3951; C11D 3/3953; C11D 3/3955; C11D 7/265; C11D 17/0039
USPC ..... 510/309, 376, 379, 380, 381, 441, 477, 510/488
See application file for complete search history.

(56) References Cited

U.S. PATENT DOCUMENTS

| | | | | |
|---|---|---|---|---|
| 4,078,099 A | | 3/1978 | Mazzola | |
| 4,126,717 A | | 11/1978 | Mazzola | |
| 4,136,052 A | | 1/1979 | Mazzola | |
| 4,327,151 A | | 4/1982 | Mazzola | |
| 4,655,780 A | | 4/1987 | Chun et al. | |
| 4,657,784 A | * | 4/1987 | Olson | C11D 3/395 427/213 |
| 4,681,914 A | * | 7/1987 | Olson | C11D 3/395 510/381 |
| 4,731,195 A | * | 3/1988 | Olson | B01J 2/006 252/186.34 |
| 4,762,637 A | | 8/1988 | Aronson et al. | |
| 4,830,773 A | * | 5/1989 | Olson | C11D 3/3953 252/186.35 |
| 4,863,632 A | | 9/1989 | Aronson et al. | |
| 5,200,236 A | | 4/1993 | Lang et al. | |

(Continued)

FOREIGN PATENT DOCUMENTS

| | | |
|---|---|---|
| CN | 101360812 | 2/2009 |
| DE | 19506004 | 8/1996 |

(Continued)

OTHER PUBLICATIONS

International Search report dated May 30, 2017 in International (PCT) Application No. PCT/JP2017/016111, with English translation.
Written Opinion of International Searching Authority dated May 30, 2017 in International (PCT) Application No. PCT/JP2017/016111.
Third Party Observation filed Aug. 21, 2018 in corresponding International (PCT) Application No. PCT/JP2017/016111, with English translation.
Office Action dated Dec. 4, 2019 in corresponding Chinese Patent Application No. 201780024664.3, with English Translation.

(Continued)

*Primary Examiner* — Gregory R Delcotto
(74) *Attorney, Agent, or Firm* — Wenderoth, Lind & Ponack, L.L.P.

(57) ABSTRACT

A stabilized solid bleaching agent which has good solubility in water without undergoing the occurrence of foaming and without generating residues has been demanded. The present invention provides a stabilized solid-bleaching-agent-containing material having a coating layer formed therein, wherein the coating layer contains at least one component selected from the group consisting of an alkali metal salt of an aromatic carboxylic acid, an alkali metal salt of a non-cyclic dicarboxylic acid, an alkali metal salt of a non-cyclic monocarboxylic acid having 1 to 7 carbon atoms and mixtures thereof.

7 Claims, No Drawings

(56) References Cited

U.S. PATENT DOCUMENTS

| | | | | |
|---|---|---|---|---|
| 5,213,705 | A * | 5/1993 | Olson | C11D 3/395 252/186.35 |
| 5,230,822 | A | 7/1993 | Kamel et al. | |
| 5,258,132 | A | 11/1993 | Kamel et al. | |
| 5,340,496 | A | 8/1994 | Sato et al. | |
| 5,407,598 | A | 4/1995 | Olson et al. | |
| 5,827,811 | A | 10/1998 | Lagnemo et al. | |
| 5,846,922 | A | 12/1998 | Lagnemo et al. | |
| 5,902,783 | A | 5/1999 | Lagnemo et al. | |
| 5,929,015 | A | 7/1999 | Lagnemo et al. | |
| 6,071,431 | A | 6/2000 | Lagnemo et al. | |
| 6,255,272 | B1 | 7/2001 | Lagnemo et al. | |
| 6,589,443 | B1 | 7/2003 | Olson et al. | |
| 8,252,200 | B2 | 8/2012 | Lei et al. | |
| 2002/0028757 | A1 | 3/2002 | Esposito et al. | |
| 2004/0082491 | A1* | 4/2004 | Olson | C11D 3/3955 510/375 |
| 2004/0157761 | A1* | 8/2004 | Man | C11D 1/04 510/302 |
| 2007/0125979 | A1 | 6/2007 | Lei et al. | |
| 2008/0200364 | A1 | 8/2008 | Garaffa et al. | |
| 2012/0058927 | A1* | 3/2012 | Borchers | C11D 17/06 510/220 |
| 2014/0100152 | A1* | 4/2014 | Heppert | C11D 3/3945 510/224 |
| 2014/0206593 | A1* | 7/2014 | Simonsen | C11D 3/3932 510/374 |
| 2018/0192643 | A1* | 7/2018 | Fast | C02F 1/76 |

FOREIGN PATENT DOCUMENTS

| | | |
|---|---|---|
| DE | 195 06 005 | 8/1998 |
| EP | 0 407 189 | 1/1991 |
| JP | 53-26782 | 3/1978 |
| JP | 60-188498 | 9/1985 |
| JP | 62-177100 | 8/1987 |
| JP | 63-154798 | 6/1988 |
| JP | 3-40909 | 2/1991 |
| JP | 5-9500 | 1/1993 |
| JP | 6-313200 | 11/1994 |
| JP | 8-507095 | 7/1996 |
| JP | 9-86908 | 3/1997 |
| JP | 9-227108 | 9/1997 |
| JP | 10-507220 | 7/1998 |
| JP | 10-508329 | 8/1998 |
| JP | 10-508629 | 8/1998 |
| JP | 2002-543270 | 12/2002 |
| JP | 2004-503687 | 2/2004 |
| JP | 2009-7566 | 1/2009 |
| JP | 2009-507122 | 2/2009 |
| JP | 2014-193964 | 10/2014 |
| WO | 00/66688 | 11/2000 |
| WO | 2007/064681 | 6/2007 |
| WO | 2013/047103 | 4/2013 |
| WO | 2015/012235 | 1/2015 |

OTHER PUBLICATIONS

Extended European Search Report dated Oct. 23, 2019, in corresponding European Patent Application No. 17786063.2.

Office Action dated Aug. 26, 2020 in corresponding Chinese Patent Application No. 201780024664.3 with English-language translation.

Office Action dated Feb. 9, 2021 in corresponding Japanese Patent Application No. 2020-025127, with English Translation.

Decision of Rejection dated Mar. 3, 2021 in corresponding Chinese Patent Application No. 201780024664.3, with English Translation, 12 pages.

Office Action dated Mar. 19, 2021 in corresponding Korean Patent Application No. 10-2018-7030169, with English Translation, 13 pages.

* cited by examiner

MATERIAL CONTAINING SOLID BLEACHING AGENT, AND DETERGENT COMPOSITION

TECHNICAL FIELD

The present invention relates to a solid bleaching agent-containing material, and a detergent composition, and more specifically, to a solid bleaching agent-containing material having a coating layer, and to a detergent composition.

BACKGROUND ART

In order to wash drain pipes or water storage parts of kitchens, bathrooms, washrooms, toilets, and the like, to wash clothes and the like, to wash dishes and utensils, or to keep bath water or pool water clean, solid bleaching agents have been widely used for the purpose of washing, sterilization, bleaching, or the like. Such solid bleaching agents are used in various forms such as powders, granules and tablets, depending on applications, and may be used as a mixture with another component such as various surfactants, alkaline agents and metal ion scavengers, which contributes to washing.

In the case where the solid bleaching agent is used as a mixture with other components, due to a high reactivity of the solid bleaching agent, the solid bleaching agent reacts with the other components. As a result, not only deterioration, deactivation or decomposition of the solid bleaching agent but also decomposition or deterioration of other components are caused at the same time, and thus, effects of washing, sterilization, bleaching, or the like are remarkably decreased. Therefore, in order to prevent such a reaction between the solid bleaching agent and other components, a method of coating or encapsulating the solid bleaching agent has been proposed.

For example, PTL 1 and PTL 2 disclose that stability of a chlorinated isocyanuric acid compound, which is a core component of an active halogen bleaching agent, can be improved by forming a first layer composed of an inorganic salt and a second layer composed of a synthetic surfactant such as an n-alkylsulfonate on a surface of the chlorinated isocyanuric acid compound. In addition, PTL 3 discloses bleaching agent particles encapsulated with a fatty acid soap having a carbon number of from 16 to 18 and an alkali metal fatty acid soap having a carbon number of from 12 to 14. However, these synthetic surfactants and fatty acid soaps are surfactants having a high foamability. The use of bleaching agent particles containing such a surfactant not only requires excessive rinsing work to flush foam after use and in addition, causes problems, for example, causing a decrease in flow velocity due to foam being sucked into a pump in the case where water is used in circulation such as in a dishwasher for institutional use or a chiller facility. In addition, in the dishwasher, in order to jet a washing liquid at a high pressure, it is required to be non-foamable. Therefore, there remain problems that bleaching agent particles containing such a surfactant cannot be used in the case where a foamability is not required or in the case where a foamability interferes with use thereof, and have limited applications.

PTL 4 discloses particles obtained by enclosing a bleaching agent by one or more types of paraffin wax having a melting point of from 40° C. to 50° C. and a solid content of from 35 to 100% at 40° C. and from 0 to 15% at 50° C. However, such paraffin waxes are insoluble in water. Thus, in the case of being used under a condition that a temperature is below the melting point, there are problems that not only a bleaching agent cannot be substantially released into washing water, but also the particles themselves become residues and remain. In addition, even in the case of being used under a condition that the temperature exceeds 40° C., since a melted paraffin wax is insoluble in water, it is necessary to separately blend an emulsifier or the like so as to prevent the paraffin wax from remaining. Furthermore, there has been still a problem such as becoming a residue again in the case where the temperature decreases after use.

PTL 5 discloses a multilayer-coated bleaching agent containing a saturated fatty acid, a microcrystalline wax and a polyoxyethylene-polyoxypropylene copolymer. In addition, PTL 6 discloses bleaching agent-encapsulated particles containing a first coating agent composed of a paraffin wax or the like, and a second coating agent composed of powders of zeolite A and calcium stearate. However, such coatings have a problem that residues remain similar to the invention described in PTL 4, since the saturated fatty acid, microcrystalline wax, paraffin wax, zeolite A, and calcium stearate are insoluble in water. Furthermore, an organic polymer such as polyoxyethylene-polyoxypropylene has reactivity with a solid bleaching agent. Thus, it is necessary to isolate the organic polymer by providing a layer of fatty acid or the like so that the solid bleaching agent and polyoxyethylene-polyoxypropylene do not come into direct contact with each other, which leads to a problem of complicated processing. In the case where these organic polymers or the like are used for coating, it is extremely difficult to perform processing while completely blocking the contact between the organic polymer and the solid bleaching agent throughout a period from the start of production to the end of use. Thus, there has been a problem that there is a high probability of deterioration, deactivation or decomposition of the bleaching agent, or decomposition of other materials occurring during processing.

PTL 7 describes a powder detergent for an automatic dishwashing machine, which contains a particulate oxidizing component having a coating of a polycarboxylate such as poly(methacrylic acid). However, although such a polycarboxylate is insoluble in water at an ordinary neutral pH and has a slightly improved solubility in water at an alkaline pH, the problem of residue generation has not been solved yet. In addition, the polycarboxylate has reactivity with an oxidizing halogen bleaching agent due to a functional group such as an ester group in its molecule. Thus, in the case where the bleaching agent is coated with a polymer containing such a functional group, a decomposition reaction progresses gradually between the polycarboxylate and the bleaching agent, and the coating is deteriorated. Therefore, there are problems that the storage stability is adversely affected and the bleaching agent is deteriorated, deactivated or decomposed due to the reaction with the coating agent.

PTL 8 discloses a chlorine bleaching agent composition containing a solid-state chlorine bleaching agent and sodium benzoate, which is in the form of a tablet. However, it is only suggested that blending of sodium benzoate causes improvement of tabletability due to effects of reducing moisture absorption of the tablet and effects of lubrication. It cannot make possible mixing the solid-state chlorine bleaching agent with other components such as various surfactants, alkaline agents, metal ion scavengers, and the like, which contribute to washing, and there is no suggestion that sodium benzoate can be used in a coating layer.

As can be seen from such literatures, it is considered that a relatively high molecular weight surfactant, a polysaccharide, a hydrocarbon such as wax, a high-molecular polymer, and the like are suitable as a coating material for stabilizing the solid bleaching agent. However, in the case where these compounds are used in the coating layer, protection effects for the solid bleaching agent are not sufficient and in addition, these compounds themselves react with the solid bleaching agent in some cases. Furthermore, the solid bleaching agent has reactivity with many organic substances. Thus, selection thereof has to be made from a limited range of compounds, and the problem of foaming or residue generation has not been solved yet.

On the other hand, in the case where a compound such as a water-soluble inorganic salt is used as a coating material, unnecessary foaming or residue generation can be avoided. However, since the water-soluble inorganic salt itself does not form a coating layer, it has drawbacks that it is not suitable as a coating material or even in the case of forming a coating layer, it has a low stabilization effect of protecting the solid bleaching agent from factors such as deterioration, deactivation and decomposition. In order to compensate for these drawbacks, it is necessary to use the water-soluble inorganic salt, for example, in combination with the above-described relatively large molecular weight surfactant, polysaccharide, hydrocarbon such as wax, high-molecular polymer, or the like, to form a multilayer film.

As described above, there is a demand for a solid bleaching agent-containing material having a coating layer which has good solubility in water without foaming and does not generate residues.

CITATION LIST

Patent Literature

[PTL 1] JP-A H05-9500
[PTL 2] JP-T H08-507095
[PTL 3] JP-A S62-177100
[PTL 4] JP-A H06-313200
[PTL 5] JP-A S53-26782
[PTL 6] JP-A 2009-7566
[PTL 7] JP-A S63-154798
[PTL 8] JP-A S60-188498

SUMMARY OF INVENTION

Technical Problem

Provided are a solid bleaching agent-containing material having a coating layer, and a detergent composition in which the same is blended. The solid bleaching agent-containing material having a coating layer, and the detergent composition in which the same is blended can be stabilized by protecting a solid bleaching agent from deterioration, deactivation and decomposition. Furthermore, effects of generating only a small amount of foaming or no foaming can be exerted. In addition, effects of having good solubility in water and of generating only a small amount of residues or no residues can be exerted.

Solution to Problem

As a result of conducting intensive studies in view of the above problems, the present inventors have found that in the case where a material used for a coating layer is selected from one or more selected from the group consisting of alkali metal salts of aromatic carboxylic acids, alkali metal salts of acyclic dicarboxylic acids, alkali metal salts of acyclic monocarboxylic acids having a carbon number of from 1 to 7, and mixtures thereof (hereinafter simply referred to as alkali metal salts of carboxylic acids in some cases), a solid bleaching agent-containing material having the coating layer and a detergent composition in which the same is blended can be stabilized due to protection of a solid bleaching agent from deterioration, deactivation and decomposition. Furthermore, the present inventors have found that the solid bleaching agent-containing material can exert effects of generating only a small amount of foaming or no foaming. In addition, the present inventors have found that the solid bleaching agent-containing material can exert effects of having good solubility in water and generating only a small amount of residues or no residues.

Furthermore, the present inventors have found that an alkali metal salt of an aromatic carboxylic acid, an alkali metal salt of an acyclic dicarboxylic acid, an alkali metal salt of an acyclic monocarboxylic acid having a carbon number of from 1 to 7, and a mixture thereof, which are used as a coating layer, are stable with respect to bleaching agent particles and do not cause undesirable side reactions between the solid bleaching agent and the coating layer, so that there is no need to provide a separate layer for secluding the solid bleaching agent from the coating layer, and a coating layer can be provided directly on a surface of the solid bleaching agent.

In the present invention, "generating no foaming" means that the amount of foam generated is nil or extremely small in the case where an aqueous solution of a solid bleaching agent-containing material having a coating layer which is modulated to a certain concentration is mixed or stirred. And "having good solubility in water and generating no residues" means that the aqueous solution of a solid bleaching agent-containing material having a coating layer which is modulated to a certain concentration is clear without being suspended and generates no or an extremely small amount of insolubles (precipitates or floating matters). In addition, "being stabilized" means that in the case where the solid bleaching agent-containing material having a coating layer is stored for a certain period of time, deterioration, inactivation and decomposition of the solid bleaching agent is suppressed (decreased), as compared with the case of the solid bleaching agent having no coating layer.

As used in the present invention, "an alkali metal salt of a carboxylic acid" means a salt obtained by neutralizing a carboxyl group in a molecule with an alkali metal. It is not necessary that all the carboxyl groups in the molecule are neutralized, and a partially neutralized salt may be used.

As used in the present invention, "solid" means being sufficient to be solid within a usable temperature range of the solid bleaching agent and a compound having a melting point may be included. In addition, one obtained by causing a liquid to be adsorbed onto a known adsorbent or the like and making it into a powder form, and one obtained by making an oil or a gel into a capsule form may be included.

In the present invention, the solid bleaching agent-containing material having a coating layer can be used by being blended with a detergent composition in order to further enhance effects of washing, sterilization, bleaching, and the like. Various components such as an alkaline agent, a chelating agent and a surfactant can be blended in such a detergent composition as a component other than the solid bleaching agent.

That is, the present invention relates to a solid bleaching agent-containing material having a coating layer, and a detergent composition in which the same is blended.

Item 1: A solid bleaching agent-containing material, including: a first layer containing a solid bleaching agent; and a second layer formed of a coating layer, in which the coating layer contains one or more selected from the group consisting of alkali metal salts of aromatic carboxylic acids, alkali metal salts of acyclic dicarboxylic acids, alkali metal salts of acyclic monocarboxylic acids having a carbon number of from 1 to 7, and mixtures thereof.

Item 2: The solid bleaching agent-containing material according to Item 1, in which the alkali metal salt of an aromatic carboxylic acid is one or more selected from the group consisting of alkali metal salts of benzoic acid, ortho-phthalic acid, meta-phthalic acid, para-phthalic acid, trimellitic acid, and para-t-butylbenzoic acid, and mixtures thereof.

Item 3: The solid bleaching agent-containing material according to Item 1, in which the alkali metal salt of an acyclic dicarboxylic acid is one or more selected from the group consisting of alkali metal salts of succinic acid, glutaric acid, adipic acid, suberic acid, azelaic acid, sebacic acid, undecanedioic acid, dodecanedioic acid, and tetradecanedioic acid, and mixtures thereof.

Item 4: The solid bleaching agent-containing material according to Item 1, in which the alkali metal salt of an acyclic monocarboxylic acid having a carbon number of from 1 to 7 is one or more selected from the group consisting of alkali metal salts of formic acid, acetic acid, propionic acid, butyric acid, valeric acid, hexanoic acid, and heptanoic acid, and mixtures thereof.

Item 5: The solid bleaching agent-containing material according to Item 1, in which the solid bleaching agent is one or more selected from the group consisting of halogen bleaching agents, oxygen bleaching agents, and mixtures thereof.

Item 6: The solid bleaching agent-containing material according to Item 5, in which the halogen bleaching agent is one or more selected from the group consisting of halogenated isocyanuric acids, alkali metal salts of halogenated isocyanuric acids, hydrates of alkali metal salts of halogenated isocyanuric acids, halogenated hydantoins, hypochlorous acid metal salts, and mixtures thereof.

Item 7: The solid bleaching agent-containing material according to Item 5, in which the oxygen bleaching agent is one or more selected from the group consisting of percarbonates, perborates, peroxysulfates, and mixtures thereof.

Item 8: A detergent composition, including: the solid bleaching agent-containing material as described in Item 1, blended with one or more metal ion scavengers selected from the group consisting of aminocarboxylic acid salts, hydrates of aminocarboxylic acid salts, hydroxyaminocarboxylic acid salts, hydrates of hydroxyaminocarboxylic acid salts, and mixtures thereof.

Item 9: A detergent composition, including: the solid bleaching agent-containing material as described in Item 1, blended with one or more nonionic surfactants.

Item 10: A detergent composition, including: the solid bleaching agent-containing material as described in Item 1, blended with one or more alkali metal salts selected from the group consisting of alkali metal hydroxides, alkali metal silicates, alkali metal carbonates, alkali metal phosphates, and mixtures thereof.

Advantageous Effects of Invention

In the case where a solid bleaching agent is used for the purpose of washing, sterilization, bleaching, or the like in order to wash drain pipes or water storage parts of kitchens, bathrooms, washrooms, toilets, and the like, to wash clothes and the like, to wash dishes and utensils, or to keep bath water or pool water clean, the solid bleaching agent-containing material having a coating layer of the present invention not only can improve deterioration, deactivation and decomposition of the bleaching agent, which occurs in the case of being mixed with compounds such as various surfactants, alkaline agents and metal ion scavengers as components for enhancing effects of washing, sterilization, bleaching, and the like, but also can improve deterioration and decomposition of the various compounds mixed with the bleaching agent, at the same time. In addition, the solid bleaching agent-containing material not only can exert effects of generating only a small amount of foaming or no foaming, but also can exert effects of having good solubility in water and generating only a small amount of residues or no residues. Thus, the solid bleaching agent-containing material can be used for a wide range of applications. Furthermore, the protection of the bleaching agent particles by the coating layer prevents the solid bleaching agent from being brought into contact with the other compounds and imparts a characteristic that undesirable side reactions such as deterioration, deactivation or decomposition which occurs between the solid bleaching agent and the other compounds do not occur.

Since one or more selected from the group consisting of alkali metal salts of aromatic carboxylic acids, alkali metal salts of acyclic dicarboxylic acids, alkali metal salts of acyclic monocarboxylic acids having a carbon number of from 1 to 7, and mixtures thereof are used in the coating layer, a solid bleaching agent-containing material having the coating layer and a detergent composition in which the same is blended can be stabilized due to the protection of the solid bleaching agent from deterioration, deactivation and decomposition. Furthermore, the coating layer formed by containing any one or more selected from the group consisting of the alkali metal salts of aromatic carboxylic acids, alkali metal salts of acyclic dicarboxylic acids, alkali metal salts of acyclic monocarboxylic acids having a carbon number of from 1 to 7, and the mixtures thereof is extremely stable even in the case of being brought into contact with the solid bleaching agent, and there are no undesirable side reactions between the solid bleaching agent and the coating layer. Thus, it is characterized that there is no need to provide a separate layer for secluding the solid bleaching agent from the coating layer, and a coating layer can be provided directly on a surface of the solid bleaching agent. In addition, at the time when a coating layer is formed on the solid bleaching agent by using one or more selected from the group consisting of the alkali metal salts of aromatic carboxylic acids, alkali metal salts of acyclic dicarboxylic acids, alkali metal salts of acyclic monocarboxylic acids having a carbon number of from 1 to 7, and the mixtures thereof, it is characterized that the coating layer hardly aggregates and has excellent processability.

In the case where the solid bleaching agent is any of a halogen bleaching agent, an oxygen bleaching agent or a mixture thereof, excellent effects of washing, sterilization, bleaching, and the like can be exhibited.

In addition, in the case where the halogen bleaching agent is one or more selected from the group consisting of halogenated isocyanuric acids, alkali metal salts of halogenated isocyanuric acids, hydrates of alkali metal salts of halogenated isocyanuric acids, halogenated hydantoins, hypochlorous acid metal salts, and mixtures thereof, and in the case where the oxygen bleaching agent is one or more selected from the group consisting of percarbonates, perborates, peroxysulfates, and mixtures thereof, not only excellent effects of washing, sterilization, bleaching, and the like can be exhibited, but also easy availability and excellent handleability can be achieved, thereby making it possible to carry out implementation within an economically acceptable range.

Even in the case where the detergent composition in which the solid bleaching agent-containing material having a coating layer of the present invention is blended, is mixed with detergent components such as various metal ion scavengers including aminocarboxylic acid salts, hydrates thereof, hydroxyaminocarboxylic acid salts, and hydrates thereof, various surfactants including nonionic surfactants, and various alkaline agents including alkali metal hydroxides, alkali metal silicates, alkali metal carbonates, and alkali metal phosphates, in order to increase effects of the detergent composition, when using a solid bleaching agent for the purpose of washing, sterilization, bleaching, or the like, not only the problem of deterioration, deactivation and decomposition of the solid bleaching agent can be improved, but also the problem of occurrence of deterioration or decomposition of the metal ion scavenger, surfactant, alkaline agent, or the like which is a detergent component can be improved. Therefore, it is characterized that even in the case where the detergent composition undergoes storage or keeping under a severe condition such as warming or humidification for a certain period of time, effects of washing, sterilization, bleaching, or the like of the detergent composition are maintained higher.

DESCRIPTION OF EMBODIMENTS

Hereinafter, the present invention will be described in detail. In the present specification, "mass" is synonymous with "weight".

The solid bleaching agent-containing material of the present invention contains a first layer containing a solid bleaching agent, and a second layer composed of a coating layer, in which the coating layer contains one or more selected from the group consisting of alkali metal salts of aromatic carboxylic acids, alkali metal salts of acylic dicarboxylic acids, alkali metal salts of acyclic monocarboxylic acids having a carbon number of from 1 to 7, and mixtures thereof.

In the present invention, the alkali metal salt of an aromatic carboxylic acid is an alkali metal salt of a carboxylic acid represented by Chemical Formula (I-1), (I-2), (I-3), or (I-4), which may have, in a molecule, one or more aromatic rings and one or more carboxyl groups. In the present specification, cases intended by "which may have a substituent" are meant to include, for example, the "case where a carbon chain is linear with no substituent" and the "case where a carbon chain is branched".

[Chem. 1]

(I-1)

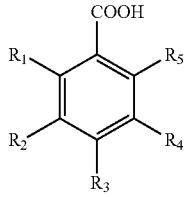

(In Chemical Formula (I-1), $R_1$, $R_2$, $R_3$, $R_4$, and $R_5$ each independently represents a hydrogen atom, an alkyl group having a carbon number of from 1 to 6 which may have a substituent, an aryl group having a carbon number of from 6 to 14 which may have a substituent, an unsaturated hydrocarbon having a carbon number of from 1 to 17, an acyl group having a carbon number of from 1 to 17, an alkoxyl group having a carbon number of from 1 to 6, a carboxyl group, a hydroxyl group, a nitro group, an amino group, a sulfonic acid group, a mercapto group, a fluorine atom, a chlorine atom, a bromine atom, or an iodine atom.)

[Chem. 2]

(I-2)

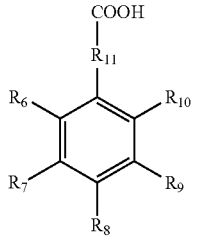

(In Chemical Formula (I-2), $R_6$, $R_7$, $R_8$, $R_9$, and $R_{10}$ each independently represents a hydrogen atom, an alkyl group having a carbon number of from 1 to 6 which may have a substituent, an aryl group having a carbon number of from 6 to 14 which may have a substituent, an unsaturated hydrocarbon having a carbon number of from 1 to 17, an acyl group having a carbon number of from 1 to 17, an alkoxyl group having a carbon number of from 1 to 6, a carboxyl group, a hydroxyl group, a nitro group, an amino group, a sulfonic acid group, a mercapto group, a fluorine atom, a chlorine atom, a bromine atom, or an iodine atom. $R_{11}$ represents a methylene group, an alkylene group having a carbon number of from 1 to 6 which may have a substituent, or an unsaturated hydrocarbon having a carbon number of from 2 to 6 which may have a substituent.)

[Chem. 3]

(I-3)

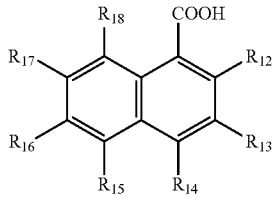

(In Chemical Formula (I-3), $R_{12}$, $R_{13}$, $R_{14}$, $R_{15}$, $R_{16}$, $R_{17}$, and $R_{18}$ each independently represents a hydrogen atom, an alkyl group having a carbon number of from 1 to 6 which may have a substituent, an aryl group having a carbon number of from 6 to 14 which may have a substituent, an unsaturated hydrocarbon having a carbon number of from 1 to 17, an acyl group having a carbon number of from 1 to 17, an alkoxyl group having a carbon number of from 1 to 6, a carboxyl group, a hydroxyl group, a nitro group, an amino group, a sulfonic acid group, a mercapto group, a fluorine atom, a chlorine atom, a bromine atom, or an iodine atom.)

[Chem. 4]

(I-4)

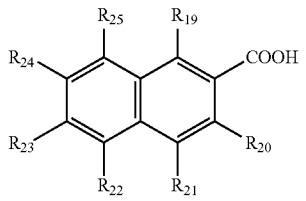

(In Chemical Formula (I-4), $R_{19}$, $R_{20}$, $R_{21}$, $R_{22}$, $R_{23}$, $R_{24}$, and $R_{25}$ each independently represents a hydrogen atom, an alkyl group having a carbon number of from 1 to 6 which may have a substituent, an aryl group having a carbon number of from 6 to 14 which may have a substituent, an unsaturated hydrocarbon having a carbon number of from 1 to 17, an acyl group having a carbon number of from 1 to 17, an alkoxyl group having a carbon number of from 1 to 6, a carboxyl group, a hydroxyl group, a nitro group, an amino group, a sulfonic acid group, a mercapto group, a fluorine atom, a chlorine atom, a bromine atom, or an iodine atom.)

Preferable alkali metal salt of the aromatic carboxylic acid used in the present invention include one or more selected from the group consisting of alkali metal salts of benzoic acid, salicylic acid, 3-hydroxybenzoic acid, 4-hydroxybenzoic acid, cinnamic acid, ortho-toluic acid, meta-toluic acid, para-toluic acid, ortho-phthalic acid, meta-phthalic acid, para-phthalic acid, phenylacetic acid, 2-phenylpropionic acid, phenoxyacetic acid, phenylpyruvic acid, ortho-t-butylbenzoic acid, meta-t-butylbenzoic acid, para-t-butylbenzoic acid, 3,5-di-t-butylbenzoic acid, 3,5-di-t-butylsalicylic acid, ortho-benzoylbenzoic acid, meta-benzoylbenzoic acid, para-benzoylbenzoic acid, anthranilic acid, 1-naphthoic acid, 2-naphthoic acid, 1,2-naphthalene dicarboxylic acid, 2,3-naphthalene dicarboxylic acid, 3-hydroxy-2-naphthoic acid, 2-hydroxyphenylacetic acid, 3-hydroxyphenylacetic acid, 4-hydroxyphenylacetic acid, D-mandelic acid, L-mandelic acid, trimellitic acid, pyromellitic acid, 2-methoxyphenylacetic acid, 3-methoxyphenylacetic acid, and 4-methoxyphenylacetic acid, and mixtures thereof.

From the viewpoint of easy availability, safety, non-reactivity with a solid bleaching agent, and easy forming a coating layer, and from the viewpoint of high stability of a solid bleaching agent-containing material in the case of being blended with a detergent composition, as the alkali metal salt of the aromatic carboxylic acid, one or more selected from the group consisting of alkali metal salts of benzoic acid, ortho-phthalic acid, meta-phthalic acid, para-phthalic acid, trimellitic acid, and para-t-butylbenzoic acid, and mixtures thereof are more preferable.

As the metal salt, an alkali metal salt such as lithium salt, sodium salt and potassium salt, and an alkaline earth metal salt such as calcium salt can be used. From the viewpoint of easy availability, the alkali metal salt is preferable, and from the viewpoint of solubility in water, sodium salt and potassium salt are more preferable.

In the present invention, the alkali metal salt of the acyclic dicarboxylic acid is an alkali metal salt of a dicarboxylic acid represented by Chemical Formula (II-1) or Chemical Formula (II-2) which may have an acyclic hydrocarbon chain which may have a substituent, and at least two carboxyl groups.

[Chem. 5]

$$HOOC—R_{26}—COOH \quad \text{(II-1)}$$

(In Chemical Formula (II-1), $R_{26}$ is an alkylene group having a carbon number of from 1 to 34 which may have a substituent or an acyclic unsaturated hydrocarbon having a carbon number of from 1 to 34 which may have a substituent.)

[Chem. 6]

$$HOOC—COOH \quad \text{(II-2)}$$

Preferable alkali metal salt of the acyclic dicarboxylic acid used in the present invention include one or more selected from the group consisting of alkali metal salts of oxalic acid, malonic acid, succinic acid, fumaric acid, maleic acid, D-tartaric acid, L-tartaric acid, D-malic acid, L-malic acid, D-aspartic acid, L-aspartic acid, glutaric acid, D-glutamic acid, L-glutamic acid, itaconic acid, adipic acid, pimelic acid, suberic acid, azelaic acid, sebacic acid, undecanedioic acid, dodecanedioic acid, and tetradecanedioic acid, and mixtures thereof.

From the viewpoint of easy availability and safety, as the alkali metal salt of the acyclic dicarboxylic acid, one or more selected from the group consisting of alkali metal salts of succinic acid, glutaric acid, adipic acid, suberic acid, azelaic acid, sebacic acid, undecanedioic acid, dodecanedioic acid, and tetradecanedioic acid, and mixtures thereof are more preferable.

As the metal salt, an alkali metal salt such as lithium salt, sodium salt and potassium salt, and an alkaline earth metal salt such as calcium salt can be used. From the viewpoint of easy availability, the alkali metal salt is preferable, and from the viewpoint of solubility in water, sodium salt and potassium salt are more preferable.

In the present invention, the alkali metal salt of the acyclic monocarboxylic acid having a carbon number of from 1 to 7 is an alkali metal salt of a carboxylic acid represented by Chemical Formula (III) which may have an acyclic hydrocarbon chain which may have a substituent, and one carboxyl group, and in which a sum of the carbon number in the molecule may be from 1 to 7.

[Chem. 7]

$$R_{27}—COOH \quad \text{(III)}$$

(In Chemical Formula (III), $R_{27}$ represents a hydrogen atom, an acyclic alkyl group having a carbon number of from 1 to 6 which may have a substituent, or an acyclic unsaturated hydrocarbon having a carbon number of from 1 to 6 which may have a substituent.)

Preferable alkali metal salt of the acyclic monocarboxylic acid having a carbon number of from 1 to 7 used in the present invention include one or more selected from the group consisting of alkali metal salts of formic acid, acetic acid, propionic acid, butyric acid, valeric acid, hexanoic acid (caproic acid), heptanoic acid (enanthic acid), acrylic acid, methacrylic acid, isobutyric acid, and isovaleric acid, and mixtures thereof.

From the viewpoint of easy availability, as the alkali metal salt of the acyclic monocarboxylic acid having a carbon number of from 1 to 7, one or more selected from the group consisting of alkali metal salts of formic acid, acetic acid, propionic acid, butyric acid, valeric acid, hexanoic acid, and heptanoic acid, and mixtures thereof are more preferable. Furthermore, from the viewpoints of non-reactivity with respect to a solid bleaching agent and non-aggregating properties during processing, one or more selected from the group consisting of alkali metal salts of propionic acid, butyric acid and valeric acid which have a carbon number of from 3 to 5, and mixtures thereof are even more preferable.

As the metal salt, an alkali metal salt such as lithium salt, sodium salt and potassium salt, and an alkaline earth metal salt such as calcium salt can be used. From the viewpoint of easy availability, the alkali metal salt is preferable, and from the viewpoint of solubility in water, sodium salt and potassium salt are more preferable.

The alkali metal salt of a carboxylic acid used in the present invention may be the use of an alkali metal salt of a previously neutralized carboxylic acid, or may be prepared by neutralizing a carboxylic acid with an alkali metal. A method of neutralizing a carboxylic acid with an alkali metal includes a preparation of dissolving a carboxylic acid in an aqueous solution of an alkali metal hydroxide or the like.

For example, in the case of preparing an alkali metal salt of a dicarboxylic acid having two carboxyl groups in a molecule, it is possible to obtain a sodium salt of the dicarboxylic acid in which one of the two carboxyl groups in the molecule is neutralized with sodium, by dissolving the dicarboxylic acid in water in which sodium hydroxide in an amount corresponding to a molar equivalent of the dicarboxylic acid is dissolved in advance. In addition, in the case where sodium hydroxide is used in an amount corresponding to twice the molar equivalent of the dicarboxylic acid, it is possible to obtain a sodium salt of the dicarboxylic acid in which both carboxyl groups in the molecule are neutralized with sodium.

Preferable solid bleaching agent used in the present invention is one or more selected from the group consisting of a halogen bleaching agent, an oxygen bleaching agent and a mixture thereof.

Examples of the halogen bleaching agent include one or more selected from the group consisting of halogenated isocyanuric acids, alkali metal salts of halogenated isocyanuric acids, hydrates of alkali metal salts of halogenated isocyanuric acids, halogenated hydantoins, hypochlorous acid metal salts, and mixtures thereof.

Preferable examples of the halogenated isocyanuric acid, alkali metal salt of a halogenated isocyanuric acid and hydrate of an alkali metal salt of a halogenated isocyanuric acid include one or more selected from the group consisting of trichloroisocyanuric acid, sodium dichloroisocyanurate, hydrates of sodium dichloroisocyanurate, potassium dichloroisocyanurate, and mixtures thereof. From the viewpoints of easy availability and safety, one or more selected from the group consisting of trichloroisocyanuric acid, sodium dichloroisocyanurate, hydrates of sodium dichloroisocyanurate, and mixtures thereof are more preferable.

Preferable examples of the halogenated hydantoin include one or more selected from the group consisting of 1,3-dichloro-5,5-dimethylhydantoin, 1-bromo-3-chloro-5,5-dimethylhydantoin, 1-chloro-3-bromo-5,5-dimethylhydantoin, 1,3-dibromo-5,5-dimethylhydantoin, 1,3-dichloro-5,5-ethylmethylhydantoin, and mixtures thereof. Both 1-bromo-3-chloro-5,5-dimethylhydantoin and 1-chloro-3-bromo-5,5-dimethylhydantoin may be collectively referred to simply as bromochloro-5,5-dimethylhydantoin.

As the hypochlorous acid metal salt, calcium hypochlorite (bleaching powder) is preferable.

Examples of the oxygen bleaching agent include percarbonates, perborates, peroxysulfates, and organic peroxides including perbenzoic acid. Examples of the percarbonate include sodium carbonate-hydrogen peroxide adduct (sometimes simply referred to as sodium percarbonate) obtained by adding hydrogen peroxide to sodium carbonate. Examples of the perborate include sodium perborate. Examples of the peroxysulfate include peroxysulfuric acid-sulfuric acid-penta-potassium salt, potassium peroxodisulfate and mixtures thereof.

From the viewpoints of easy availability and easy handling, as the oxygen bleaching agent, one or more selected from the group consisting of sodium percarbonate, sodium perborate, peroxysulfuric acid-sulfuric acid-penta-potassium salt, and mixtures thereof are preferable.

The solid bleaching agent-containing material having the coating layer according to the present invention is stabilized due to having the coating layer as compared with conventional solid bleaching agents. Thus, it can be blended with a broader group of compounds (detergent components) to form a detergent composition, which can be used for applications such as washing, sterilization or bleaching. As the group of such compounds, one or more selected from the group of organic substances, inorganic substances and mixtures thereof can be used. In the case where a mixture is used, it may be subjected to a shaping step after mixing, or may be used as it is. In the case of being subjected to a shaping step, any size and formulation such as powder, granule, tablet, extrusion shaped product, casted solidified product, and slurry can be adopted.

In addition, in the solid bleaching agent-containing material having a coating layer of the present invention, one or more selected from the group of the above-described organic substances, inorganic substances and mixture thereof may be contained in the coating layer or may be contained in the solid bleaching agent, as additives, to the extent that effects of the invention are not impaired. Furthermore, it (they) may be formed into a separate layer different from the coating layer of the present invention to form a multilayer film.

Examples of the organic substance include organic acids, organic polymers, surfactants, rinsing agents, antifoaming agents, metal ion scavengers, coloring agents, flavoring agents, and enzymes.

As the organic acid, an aromatic carboxylic acid and an acyclic carboxylic acid can be used. However, in the case where a compound having a high molecular weight and a low solubility in water is blended, it is preferable to keep the compound in a small amount within a range which does not impair effects of the present invention that a good solubility in water is exhibited and only a small amount of residues or no residues are generated. In the case where the compound having a high molecular weight and a low solubility in water is used, it is possible to take measures such as increasing solubility in water by using the compound in combination with an alkali metal hydroxide or an alkali metal salt to cause the carboxylic acid to be an alkali metal salt.

Examples of such an organic acid include benzoic acid, salicylic acid, 3-hydroxybenzoic acid, 4-hydroxybenzoic acid, cinnamic acid, ortho-toluic acid, meta-toluic acid, para-toluic acid, ortho-phthalic acid, meta-phthalic acid, para-phthalic acid, phenylacetic acid, 2-phenylpropionic acid, phenoxyacetic acid, phenylpyruvic acid, ortho-t-butylbenzoic acid, meta-t-butylbenzoic acid, para-t-butylbenzoic acid, 3,5-di-t-butylbenzoic acid, 3,5-di-t-butylsalicylic acid, ortho-benzoylbenzoic acid, meta-benzoylbenzoic acid, para-benzoylbenzoic acid, anthranilic acid, 1-naphthoic acid, 2-naphthoic acid, 1,2-naphthalenedicarboxylic acid, 2,3-naphthalenedicarboxylic acid, 3-hydroxy-2-naphthoic acid, 2-hydroxyphenylacetic acid, 3-hydroxyphenylacetic acid, 4-hydroxyphenylacetic acid, D-mandelic acid, L-mandelic acid, trimellitic acid, pyromellitic acid, 2-methoxyphenylacetic acid, 3-methoxyphenylacetic acid, 4-methoxyphenylacetic acid, oxalic acid, malonic acid, succinic acid, fumaric acid, maleic acid, D-tartaric acid, L-tartaric acid, D-malic acid, L-malic acid, D-aspartic acid, L-aspartic acid, glutaric acid, D-glutamic acid, L-glutamic acid, itaconic acid, adipic acid, pimelic acid, suberic acid, azelaic acid, sebacic acid, undecanedioic acid, dodecanedioic acid, tetradecanedioic acid, formic acid, acetic acid, propionic acid, butyric acid, valeric acid, hexanoic acid, heptanoic acid, octanoic acid, nonanoic acid, decanoic acid, undecanoic acid, dodecanoic acid, myristic acid, stearic acid, and palmitic acid.

Examples of the organic polymer include polysaccharides such as carrageenan, guar gum, locust bean gum, alginic acid, alkali metal salts of alginic acid, dextrin, xanthan gum, pectin, starch, and derivatives thereof, methyl cellulose, carboxymethyl cellulose, alkali metal salts of carboxymethyl cellulose, ethyl cellulose, hydroxypropyl cellulose, hydroxyethyl cellulose, and other cellulose derivatives. Alternatively, synthetic polymer compounds such as polyvinyl alcohol, polyacrylamide, polyethylene glycol, polyacrylic acid, olefin-maleic anhydride sodium salt copolymer, acrylic acid-maleic acid sodium salt copolymer, diallyldimethylammonium-acrylic acid sodium salt copolymer, and copolymer of diallyl methylamine and maleic acid sodium salt, and the like can be mentioned.

Examples of the surfactant include anionic surfactants, cationic surfactants, nonionic surfactants, amphoteric surfactants, and mixtures thereof, and a surfactant with a low foamability is suitably used. In the case of adding a surfactant having a strong foamability, it is preferable to take measures such as to keep addition thereof in only a small amount within a range that does not impair effects of the present invention that only a small amount of foam is generated or no foam is generated, or to further add an antifoaming agent for suppression of foam. Among these, from the viewpoints of easy availability, easy handling and low foamability, it is preferable to use one or more nonionic surfactants.

Examples of the anionic surfactant include fatty acid salts such as potassium oleate soap, castor oil potassium soap, semi-hardened beef tallow fatty acid sodium soap, and semi-hardened beef tallow fatty acid potassium soap, alkyl sulfate ester salts such as sodium lauryl sulfate, sodium higher alcohol sulfate, triethanolamine lauryl sulfate, and ammonium lauryl sulfate, alkyl benzene sulfonates such as sodium dodecyl benzene sulfonate, alkyl naphthalene sulfonates such as sodium alkyl naphthalene sulfonates, dialkyl sulfosuccinates such as sodium dialkyl sulfosuccinates, alkyl diallyl ether sulfonates such as sodium alkyl diphenyl ether disulfonates, alkyl phosphates such as potassium alkyl phosphates, naphthalene sulfonic acid formalin condensates such as sodium salt of β-naphthalene sulfonic acid formalin condensate, aromatic sulfonic acid formalin condensates such as sodium salts of aromatic sulfonic acid formalin condensates, polyoxyethylene alkyl ether sulfate ester salts such as sodium polyoxyethylene lauryl ether sulfate, and alkyl sulfosuccinates such as sodium alkyl sulfosuccinates.

Examples of the cationic surfactant include alkyl amine salts such as coconut amine acetate and stearyl amine acetate, and quaternary ammonium salts such as lauryl trimethyl ammonium salts, stearyl trimethyl ammonium salts, distearyl dimethyl ammonium salts, alkyl benzyl dimethyl ammonium salts, cetyl trimethyl ammonium salts, stearyl trimethyl ammonium salts, behenyl trimethyl ammonium salts, distearyl dimethyl ammonium salts, and diisotetradecyl dimethyl ammonium salts.

Examples of the nonionic surfactant include polyoxyethylene alkyl ethers such as polyoxyethylene cetyl ether, polyoxyethylene stearyl ether, polyoxyethylene oleyl ether, and polyoxyethylene higher alcohol ethers, sorbitan fatty acid esters such as sorbitan laurate, sorbitan palmitate, sorbitan stearate, and sorbitan oleate, polyoxyethylene sorbitan fatty acid esters such as polyoxyethylene sorbitan laurate, polyoxyethylene sorbitan palmitate, polyoxyethylene sorbitan stearate, and polyoxyethylene sorbitan oleate, polyethylene glycol fatty acid esters such as polyethylene glycol laurate, polyethylene glycol stearate, and polyethylene glycol oleate, polyoxyethylene alkyl amines such as polyoxyethylene lauryl amine, polyoxyethylene stearyl amine, and ethylenediamine-polyoxyethylene-polyoxypropylene block polymers, alkyl alkanol amides such as lauric acid monoethanolamide, lauric acid diethanolamide, myristic acid monoethanolamide, myristic acid diethanolamide, stearic acid monoethanolamide, stearic acid diethanolamide, coconut oil fatty acid monoethanolamide, and coconut oil fatty acid diethanolamide, glycerin fatty acid esters such as stearic acid monoglyceride, stearic acid diglyceride, palmitic acid monoglyceride, palmitic acid diglyceride, oleic acid monoglyceride, and oleic acid diglyceride, and sucrose fatty acid esters.

Examples of the amphoteric surfactant include alkyl betaines such as lauryl betaine, stearyl betaine, and 2-alkyl-N-carboxymethyl-N-hydroxyethyl imidazolinium betaine, and amine oxides such as lauryl dimethyl amine oxide.

In dishwashers used in kitchens for professional use such as in restaurants, rinsing agents are used to accelerate drying of tableware in a rinsing step and to reduce white spots called water spots so as to finish with a good aesthetic appearance. As the rinsing agent, the above-described nonionic surfactants and organic polymers can be used, and other rinsing agents can be also used.

Examples of the antifoaming agent include silicone, mineral oil, polyether, or the like various antifoaming agents. These antifoaming agents are commercially available in the form of liquids, solids, emulsions, or the like. Examples of the silicone antifoaming agents include KM-89, KM-7750 and KM-7752 (all trade names, manufactured by Shin-Etsu Chemical Co., Ltd.), ANTIFOAM (registered trademark) E20 (trade name, manufactured by Kao Corporation), and TSA780, TSA739, YSA6406, YMA6509 (all trade names, manufactured by Momentive Performance Materials Japan Limited). Examples of the mineral oil antifoaming agents include NOPCO (registered trademark) 8034, SN DEFOAMER VL, SN DEFOAMER 269, NOPCO 267A (all trade names, manufactured by San Nopco Limited). Examples of the polyether antifoaming agents include SN DEFOAMER 470, SN DEFOAMER 14HP (all trade names, manufactured by San Nopco Limited). In addition, for example, antifoaming agents described in "Application of Antifoaming Agent" (CMC, supervised by Tsunetaka Sasaki, first edition published on May 30, 1991) may be used.

Examples of the metal ion scavenger include aminocarboxylic acid salts such as nitrilotriacetates, ethylenediamine tetraacetates, β-alanine diacetates, aspartic acid diacetates, methylglycine diacetates, and iminodisuccinates, and hydrates thereof, hydroxyaminocarboxylic acid salts such as serine diacetates, hydroxyiminodisuccinates, hydroxyethylethylenediamine triacetates, and dihydroxyethylglycine salts, and hydrates thereof, phosphonocarboxylic acids such as tripolyphosphates, 1-diphosphonic acid, α-methylphosphonosuccinic acid, and 2-phosphonobutane-1,2-dicarboxylic acid, and alkali metal salts and hydrates thereof, polyacrylic acid and alkali metal salts thereof, and glutamic acid diacetate and hydrate thereof. Among these, from the viewpoints of easy availability, easy handling, and metal ion repairing effects, it is preferable to use one or more metal ion scavengers selected from the group consisting of aminocarboxylic acid salts, hydrates of aminocarboxylic acid salts, hydroxyaminocarboxylic acid salts, hydrates of hydroxyaminocarboxylic acid salts, and mixtures thereof.

Examples of the coloring agent include Scarlet G conc., Permanent Red GY, SEIKAFAST (registered trademark) Carmine 3870, SEIKAFAST YELLOW 2200, SEIKAFAST YELLOW 2700 (B) (all trade names, manufactured by Dainichiseika Color & Chemicals Mfg. Co., Ltd.), Acid Blue 9, Direct Yellow 12 (all trade names, manufactured by Tokyo Chemical Industry Co., Ltd.), Phthalocyanine Blue, Riboflavin (all trade names, manufactured by Wako Pure Chemical Industries, Ltd.), and Ultramarine Blue (trade name, manufactured by Hayashi Pure Chemical Industries, Ltd.).

As the flavoring agent, conventionally-known flavoring agents can be used.

As the enzyme, various enzymes useful for washing can be used.

Examples of the inorganic substances include silicates, carbonates, sulfates, phosphates, acetates, hydroxides of alkali metals, chlorides of alkali metals, aluminum sulfates, and siloxanes. From the viewpoints of easy availability, easy dissolution in water and easy handling, silicates, carbonates, phosphates, and hydroxides of alkali metals are more preferable.

Examples of the silicates includes alkali metal silicates such as sodium silicate, sodium metasilicate, sodium orthosilicate, hydrates thereof, and mixtures thereof. Examples of the carbonates include alkali metal carbonates such as sodium carbonate, sodium bicarbonate, potassium carbonate, potassium bicarbonate, and sodium sesquicarbonate, and ammonium carbonate. Examples of the sulfates include alkali metal sulfates such as sodium sulfate and potassium sulfate, and alkaline earth metal sulfates such as magnesium sulfate. Examples of the phosphates include alkali metal phosphates such as sodium dihydrogen phosphate, potassium dihydrogen phosphate, and sodium tripolyphosphate, and ammonium dihydrogen phosphate. Examples of the alkali metal hydroxides include sodium hydroxide, potassium hydroxide, and lithium hydroxide. Examples of the alkali metal chlorides include sodium chloride, and potassium chloride. Examples of the siloxanes include dimethylpolysiloxanes. Among these, from the viewpoints of easy availability, easy handling and strength of basicity, it is preferable to use one or more alkali metal salts selected from the group consisting of alkali metal hydroxides, alkali metal silicates, alkali metal carbonates, alkali metal phosphates, and mixtures thereof.

For the solid bleaching agent-containing material having a coating layer of the present invention, any form such as powder, granule and tablet can be selected, and, from the viewpoint of handleability in the case of being used as a blending raw material for a detergent composition, powder or granule is preferable. In addition, a shape of the solid bleaching agent-containing material of the present invention is not particularly limited. The shape may be any shape such as a spherical shape, a columnar shape, a conical shape, other polyhedral shape, and needle shape, or may be a mixture of these shapes. In addition, in the case of producing the solid bleaching agent-containing material of the present invention, as a raw material, use can be made of solid bleaching agents of powders, granules, extrusion shaped products obtained by Chilsonator or the like, pulverized products of extrusion shaping, or products which have been preliminarily subjected to processing such as tableting and granulation, and the solid bleaching agents may contain additives.

In the case where the solid bleaching agent-containing material of the present invention is powders or granules, although there is no particular limitation, it has an average particle diameter within a range of preferably from 1 μm to 5,000 μm, more preferably from 10 μm to 3,000 μm, and even more preferably from 100 μm to 1,500 μm. In the case where the solid bleaching agent-containing material is used as a blending raw material in a detergent or the like, the average particle diameter of 5,000 μm or less is not too large as particles and provides good handleability, 3,000 μm or less provides better handleability, and 1,500 μm or less provides even better handleability. In addition, the average particle diameter of 5,000 μm or less makes the material easy to be used because it is possible to directly put the material into a drain port or the like with a small opening even in the case of being used for direct washing or bleaching, and 3,000 μm or less makes it easier to be used, and 1,500 μm or less makes it even easier to be used. On the other hand, the average particle diameter of 1 μm or more makes the material easy to be used because it scarcely scatters with a slight wind or static electricity during handling, and 10 μm or more makes it easier to be used, and 100 μm or more makes it even easier to be used.

Measurement of the average particle diameter can be carried out as follows, by using a 13-stage sieve with mesh openings 75 μm, 106 μm, 150 μm, 250 μm, 425 μm, 600 μm, 710 μm, 850 μm, 1,000 μm, 1,180 μm, 1,400 μm, 1,700 μm, and 2,000 μm, and saucers, stacking of the sieve is carried out on the saucer so that a sieve with a larger opening is on an upper stage. A sample is put from the uppermost sieve with mesh opening of 2,000 μm, and the stacked sieves are supported with one hand. The sieve frame is hit at a rate of about 120 times per minute. Occasionally, the sieve is placed horizontally and the sieve frame is strongly struck several times. This operation is repeated so that sieving is sufficiently performed. In the case where the sample is gathered due to static electricity or the like or in the case where fine powders adhere to an inner side or a back side of the sieve, the sample is loosened gently with a brush, and the sieving operation is performed again. Ones which passed through the sieve net are regarded as sieved-down. Here, the sieved-down refers to the test sample that passed through the sieve net by the end of sieving. In the case where the sample contains particles having a particle diameter exceeding 2,000 μm, sieves having mesh openings of 2,360 μm, 2,800 μm, 3,350 μm, 4,000 μm, 4,750 μm, 5,600 μm, or larger may be added. In the case where the sample contains a large amount of particles having a particle diameter of 75 μm or less, sieves having mesh openings of 63 μm, 53 μm, 45 μm, 38 μm, or smaller may be added.

Masses of particles remaining on the respective sieves and the saucer are weighed, and mass proportions (%) of the particles on the respective sieves are calculated. The mass proportions of the particles are integrated by adding up in order of a sieve with a smaller mesh opening from the saucer. When the mesh opening of a first sieve where the integrated mass proportion is 50% or more is set as a μm, the mesh opening of a sieve which is one stage larger than the a μm is set as b μm, the integrated mass proportion from the saucer to the a μm sieve is set as c %, and the mass proportion on the a μm sieve is set as d %, the average particle diameter can be obtained from Expression 1.

[Math. 1]

$$\text{Average particle diameter } (\mu m) = 10^S \quad \text{(Expression 1)}$$

$$S = \frac{50 - \left(c - \frac{d}{\log b - \log a} \times \log b\right)}{\frac{d}{\log b - \log a}}$$

In the case where the solid bleaching agent-containing material of the present invention is a tablet, although there is no particular limitation, a columnar shape or a barrel shape can be adopted. In the case of a columnar shape, the diameter is preferably from 5 mm to 2,000 mm from the viewpoint of easy processing and strength, and more preferably from 5 mm to 500 mm from the viewpoint of handleability. A height of the tablet is preferably from 0.5 mm to 2,000 mm, and more preferably from 0.5 mm to 500 mm. In addition, it is preferable that a value obtained by dividing the diameter (mm) of the tablet by the height (mm) of the tablet is within a range of from 1.0 to 10.0. The tablet having a diameter and height within the predetermined range is not too large so that processing is easily performed. In the case where the value obtained by dividing the diameter (mm) of the tablet by the height (mm) of the tablet is within the predetermined range, the tablet is hardly broken or chipped.

The solid bleaching agent-containing material of the present invention can be produced by forming a coating layer on a solid bleaching agent. The production method is not particularly limited, and already-known methods such as stirring method, rolling method or fluidized bed method may be adopted, or a combination thereof may be used. In the case of using a stirring method, the solid bleaching agent is fluidized by stirring with a stirring blade, a liquid (hereinafter referred to as a coating liquid) containing a component of the coating layer is added or sprayed thereto, and, if necessary, volatiles are removed by a drying means such as heating, to thereby form a coating layer. In the case of using a rolling method, the solid bleaching agent is put in a cylindrical treatment layer and rotated to fluidize the solid bleaching agent, the coating liquid is added or sprayed thereto, and, if necessary, volatiles are removed by a drying means such as heating, to thereby form a coating layer. In the case of using a fluidized bed method, the solid bleaching agent in the treatment layer is fluidized with air by using a blowing machine such as a blower, the coating liquid is added or sprayed thereto, and, if necessary, volatiles are removed by a drying means such as heating, to thereby form a coating layer.

The production of the solid bleaching agent-containing material having a coating layer of the present invention may contains: a step of bringing the coating liquid into contact with the solid bleaching agent to wet it while maintaining the solid bleaching agent in a flowable state; and a step of drying the solid bleaching agent, which has come into contact with the coating liquid, to form a coating layer on a surface of the solid bleaching agent. The solid bleaching agent-containing material obtained by this production method is stabilized because a coating layer is formed on an outer side of the solid bleaching agent which becomes a central core, and the solid bleaching agent is protected by the coating layer from various factors that cause the solid bleaching agent to be deteriorated, inactivated or decomposed. The coating layer may be formed so as to completely cover the solid bleaching agent, or the coating layer may be partially formed within a range which does not impair effects of the present invention.

The step of wetting the solid bleaching agent and the step of drying may be carried out in a simultaneous manner or alternately in a repeated manner. From the viewpoint of quickly completing the steps, it is more preferable to carry out these steps in a simultaneous manner.

The coating liquid can be prepared by mixing one or more solutes (hereinafter sometimes collectively referred to as coating materials) selected from the group of compounds, additives and mixtures thereof to be contained in the coating layer, with a solvent. A state of the coating liquid may be in a solution state in which the coating material is completely dissolved in a solvent, may be in a slurry, or may be in a state in which the solute is swollen and dispersed. From the viewpoints of easy availability and easy handling, as the solvent, preferred are one or more selected from the group consisting of organic solvents such as methanol, ethanol, propanol, 2-propanol, butanol, acetone, methyl ethyl ketone, ethyl acetate, tetrahydrofuran, and toluene, water, and mixtures thereof. Water, methanol, ethanol, and mixtures thereof are more preferable because they dissolve the coating material moderately, wet the solid bleaching agent, and then are quickly volatilized and removed. From the viewpoint of safety in handling and easy availability, water is even more preferable.

In addition, in the case where the coating material has a melting point, the coating material may be heated to a temperature higher than the melting point so as to be used in a melted state. At this time, when the solvent is not used, the step of drying the solid bleaching agent can be omitted, and the melted coating material solidifies by cooling to a temperature lower than the melting point, so that the coating layer can be easily formed, which is preferable.

The method of bringing the coating liquid into contact with the solid bleaching agent is not particularly limited. For example, the coating liquid may be sprayed onto the solid bleaching agent by using a spray, or the coating liquid may be added dropwise directly to the solid bleaching agent. From the viewpoint of bringing the coating liquid into contact uniformly, the method of spraying the coating liquid by using a spray is preferable.

A spray nozzle used for the spraying operation is not particularly limited, and a two-fluid nozzle is preferable.

In the case where the solvent such as water used in the production method of the solid bleaching agent-containing material of the present invention is not completely removed even through the drying step, or in the case where moisture in the atmosphere is absorbed by the solid bleaching agent, there is a case where the solid bleaching agent-containing material having a coating layer may contain traces of volatiles. Such volatiles can be removed by further performing drying.

In the case where the volatiles are water, a moisture content (% by mass) in the solid bleaching agent-containing material is defined as an amount of mass reduction in the case of being dried until it becomes a constant weight in a constant temperature drier set at 110° C. which is a temperature slightly higher than the boiling point of water, and is expressed by Expression 2.

[Math. 2]

$$\text{Moisture content (\% by mass)} = (W2 - W1) \times 100 / W2 \quad \text{(Expression 2)}$$

W1: Mass of sample after drying (g)

W2: Mass of sample before drying (g)

The moisture content of the solid bleaching agent-containing material of the present invention is not particularly limited, but preferably 30% by mass or less, more preferably 10% by mass or less, and even more preferably 5% by mass or less. Smaller moisture content is advantageous because a content of the solid bleaching agent per unit mass in the solid bleaching agent-containing material can be increased. Therefore, it is preferable to provide a drying step after production. For example, in the case where water is used as the solvent, it can be considered that the moisture content is approximately 0% by mass in the case of being dried to a constant weight under a temperature of 110° C.

Even in the case where the volatiles are other than water, in the same manner as described above, the content of the volatiles is defined as an amount of mass reduction in the case of being dried in a constant temperature dryer until it becomes a constant weight and can be obtained in the same manner as in the case of Expression 2, although there is no particular limitation as long as it is a temperature at which the volatiles can be sufficiently dried. The temperature at this time has to be set lower than the temperature at which the solid bleaching agent, coating material or another additive, excluding the solvent, decomposes, evaporates or sublimes.

In the case where the solid bleaching agent is a chlorine bleaching agent, an effective chlorine content (in terms of $Cl_2$) in the solid bleaching agent-containing material can be calculated by Expression 3 by using an iodine titration method. That is, iodine which is liberated by the reaction of active chlorine and potassium iodide is titrated with sodium thiosulfate solution, and the effective chlorine content is calculated by the following Expression 3.

[Math. 3]

$$\text{Effective chlorine content (\%)}=a\times f\times 0.35452/b \qquad \text{(Expression 3)}$$

a: 0.1N sodium thiosulfate solution (ml) required for titration b: Sample (g)

f: Factor of 0.1N sodium thiosulfate solution

The theoretical effective chlorine content of trichloroisocyanuric acid is 91.53%, that of sodium dichloroisocyanurate is 64.48%, and that of sodium dichloroisocyanurate dihydrate is 55.40%.

Even in the case of the oxygen solid bleaching agent, an effective oxygen content (in terms of $O_2$) in the solid bleaching agent-containing material can be calculated by using an iodine titration method. That is, iodine which is liberated by the reaction of active oxygen and potassium iodide is titrated with a sodium thiosulfate solution, and the effective oxygen content is calculated by Expression 4. In order to accelerate the reaction between active oxygen and potassium iodide, a small amount of ammonium molybdate aqueous solution adjusted to 1% by mass may be added.

[Math. 4]

$$\text{Effective oxygen content (\%)}=a\times f\times 0.08000/b \qquad \text{(Expression 4)}$$

a: 0.1N sodium thiosulfate solution (ml) required for titration b: Sample (g)

f: Factor of 0.1N sodium thiosulfate solution

For the solid bleaching agent-containing material of the present invention, a proportion (mass ratio) of the layer containing the solid bleaching agent to the coating layer can be appropriately modulated. As a proportion of the coating layer is smaller, a proportion of the solid bleaching agent becomes relatively larger, which is advantageous from the viewpoint of maintaining functions of the solid bleaching agent, such as sterilization, bleaching or washing. On the other hand, in the case of being blended with various detergent components to form a detergent composition, the greater the proportion of the coating layer, the more the stability is improved.

Accordingly, it is desirable that the proportion of the coating layer formed on the solid bleaching agent is within a certain range from the viewpoint of a relative proportion of the solid bleaching agent and from the viewpoint of improvement in stability. From the viewpoint of the relative proportion of the solid bleaching agent, the upper limit of the proportion of the coating layer in the solid bleaching agent-containing material is preferably 50% by mass or less, more preferably 40% by mass or less, and even more preferably 35% by mass or less. On the other hand, from the viewpoint of improvement in stability, the lower limit of the proportion of the coating layer in the solid bleaching agent-containing material is preferably 5% by mass or more, more preferably 10% by mass or more, and even more preferably 20% by mass or more, although it is not particularly limited as long as stability improves.

In the case where the solid bleaching agent is a chlorine bleaching agent, the proportion of the coating layer in the solid bleaching agent-containing material of the present invention can be calculated from the effective chlorine content of the solid bleaching agent-containing material according to the following Expression 5. In the case where the solid bleaching agent-containing material having a coating layer of the present invention contains a solvent, the solvent content may be calculated in advance according to Expression 2, and the solvent content may be subtracted before calculation according to Expression 5. In the same manner, in the case where the solid bleaching agent is an oxygen bleaching agent, the proportion can be calculated from the effective oxygen content instead of the effective chlorine content.

[Math. 5]

$$\text{Proportion (\% by mass) of coating layer}=(P1-P2)\times 100/P1 \qquad \text{(Expression 5)}$$

P1: Effective chlorine or effective oxygen content (% by mass) of solid bleaching agent used as raw material P2: Effective chlorine or effective oxygen content (% by mass) in solid bleaching agent-containing material having coating layer In the case where the effective chlorine content or the effective oxygen content is not used, a calculation method according to the following Expression 6 can be adopted for calculating the proportion of the coating layer in the solid bleaching agent-containing material having the coating layer.

[Math. 6]

$$\text{Proportion (\% by mass) of coating layer}=Q1\times 100/Q2 \qquad \text{(Expression 6)}$$

Q1: Mass (g) of coating layer in solid bleaching agent-containing material having coating layer Q2: Mass (g) of solid bleaching agent-containing material having coating layer For example, in the case where 0.3 g of the coating layer is contained in 1 g of the solid bleaching agent-containing material having the coating layer, the proportion (% by mass) of the coating layer is 0.3×100/1=30 according to Expression 6, and therefore 30%.

Identification and quantification of the coating layer can be measured by already-known methods. For example, in the case where an absorbance of the compound used for the coating layer is known, a content of the coating layer can be calculated by an absorbance method in which a calibration curve is prepared by modulating the concentration of the compound used in the coating layer to known concentrations, and measurements may be performed by using widely known methods such as liquid chromatography or gas chromatography. In the case where it is easier to quantify the solid bleaching agent rather than quantifying the coating layer, a mass of the coating layer can also be calculated from a mass of the solid bleaching agent according to Expression 7.

[Math. 7]

$$\text{Mass of coating layer } Q1 = Q2 - Q3 \qquad \text{(Expression 7)}$$

Q1: Mass (g) of coating layer in solid bleaching agent-containing material having coating layer Q2: Mass (g) of solid bleaching agent-containing material having coating layer Q3: Mass (g) of solid bleaching agent in solid bleaching agent-containing material having coating layer A processing apparatus used in the production of the solid bleaching agent-containing material of the present invention is not particularly limited, and one or more processing apparatuses selected from the group of commercially available stirrers, rolling machines, fluidized bed machines, and combinations thereof can be used. Processing may be completed by one processing apparatus, or a plurality of steps may be performed by different processing apparatuses. From the viewpoint of easy processing, one or more processing apparatuses selected from the group of rolling machines, fluidized bed machines and apparatuses having a combination are preferable.

As the processing apparatuses, ones commercially available under the following trade names can be mentioned. Specific examples thereof include DPZ-01 (manufactured by AS ONE Corporation), Swirling Fluidized Bed (manufactured by Dalton Co., Ltd.), New-Gra Machine (manufactured by Seishin Enterprise Co., Ltd.), Swirler (registered trademark) (manufactured by Nippon Pneumatic Mfg. Co., Ltd.), Loedige Mixer (manufactured by Matsubo Corporation), Granulex (registered trademark) (manufactured by Freund Industrial Co., Ltd.), Spir-A-Flow (registered trademark) (manufactured by Freund Industrial Co., Ltd.), CF Granulator (manufactured by Freund Industrial Co., Ltd.), High Speed Mixer (manufactured by Earth Technica Co., Ltd.), High Speed Vacuum Drier (manufactured by Earth Technica Co., Ltd.), Dynamic Drier (manufactured by Earth Technica Co., Ltd.), Multiplex (manufactured by Powrex Corporation), Vertical Granulator (manufactured by Powrex Corporation), Agro Master (registered trademark) (manufactured by Hosokawa Micron Corporation), and NARA-MIXER & GRANULATOR (manufactured by Nara Machinery Co., Ltd.). Examples of processing apparatus that can be preferably used include DPZ-01, Swirling Fluidized Bed, New-Gra Machine, Granulex, Spir-A-Flow, CF Granulator, High Speed Mixer, High Speed Vacuum Dryer, Dynamic Dryer, Multiplex, and Vertical Granulator.

The production of the solid bleaching agent-containing material of the present invention contains a step of maintaining the solid bleaching agent, which is to be a raw material, in a flowable state and a step of bringing the coating liquid into contact with the solid bleaching agent in the flowable state. The flowable state of the solid bleaching agent may be achieved by stirring or rolling, or may be achieved by air flow supplied from a blower or the like. The flowable state of the solid bleaching agent at that time is preferably set with an intensity at which the solid bleaching agent is not destroyed.

Determination as to whether or not the flowable state is with an intensity at which the solid bleaching agent is not destroyed, can be made by measuring changes in average particle diameter of the solid bleaching agent when the solid bleaching agent used for processing is made to be in the flowable state by using the processing apparatus or other method and allowed to flow over the time period required for forming the coating layer. That is, it is suggested that as the average particle diameter after treating only the solid bleaching agent in the flowable state for a predetermined time becomes smaller than the average particle diameter before being flowed, the intensity at the flowable state is too strong and the solid bleaching agent is destroyed. For example, in stirrers and rolling machines, the intensity at the flowable state can be adjusted by the revolution rate during stirring or rolling. It can be considered that the intensity at the flowable state is stronger as the revolution rate during stirring or rolling are higher. For example, in a fluidized bed apparatus, adjustment can be achieved by an air volume or wind speed of the air (hereinafter referred to as flowing air) supplied for bringing the raw material into a flowable state. It can be considered that the intensity at the flowable state is stronger as the air volume is increased or the wind speed is faster.

In the case where the intensity at the flowable state is too strong, the coating layer of the solid bleaching agent is formed while the coating layer and the solid bleaching agent or one of them is destroyed to undergo pulverization. Thus, no coating layer is formed on the solid bleaching agent, or the formation becomes insufficient. In such a case, it is preferable to decrease the intensity at the flowable state. The intensity at the flowable state can be decreased by decreasing the revolution rate of the stirrer or rolling machine, or decreasing a flow rate of the flowing air in the fluidized bed apparatus. Accordingly, for example, in the case where the solid bleaching agent is powders or granules, when the average particle diameter after treating only the solid bleaching agent in a flowable state for a predetermined time becomes excessively smaller than the average particle diameter before the treatment, the intensity at the flowable state is determined as too strong. Thus, in such a case, it is preferable to decrease the revolution rate or air flow rate to decrease the intensity at the flowable state. However, it is acceptable that the average particle diameter of the solid bleaching agent or solid bleaching agent-containing material after the treatment becomes smaller than the average particle diameter of the solid bleaching agent before the treatment within a range which does not impair effects of the present invention.

On the other hand, in the case where the intensity at the flowable state is too weak, the solid bleaching agent does not sufficiently fluidize, which not only causes insufficient formation of the coating layer but also causes the solid bleaching agent to aggregate with one another, to stick to an inner wall of the apparatus or the like. In the process of forming the coating layer on the solid bleaching agent, as the coating layer is increased, the average particle diameter of the solid bleaching agent-containing material usually becomes larger than the average particle diameter of the solid bleaching agent before processing. However, in the case where particles aggregate with one another, increase in the average particle diameter of the solid bleaching agent-containing material may proceed abruptly in some cases. In the case where the average particle diameter of the solid bleaching agent-containing material after processing is extremely large, it is suggested that aggregation of the solid bleaching agent proceeds abruptly during processing. Large particles generated by aggregation cause poor dispersion of the solid bleaching agent, for example, in the case of being blended in a detergent composition, which is not preferable. In the case where the intensity at the flowable state is too weak in this way, it is preferable to increase the revolution rate of the stirrer or rolling machine or increase the flow rate of the flowing air of the fluidized bed apparatus, to increase the intensity at the flowable state. However, it is acceptable that the average particle diameter of the solid bleaching agent or solid bleaching agent-containing material after processing becomes larger than the average particle diameter of the solid bleaching agent before processing within a range which does not impair effects of the present invention. In this way, the intensity at the flowable state can be appropriately set.

In addition, in the case where a supply rate of the coating liquid is too fast at the time of adding or spraying the coating liquid, the solid bleaching agent is too wet irrespective of the intensity at the flowable state, thereby causing the solid bleaching agent to aggregate with one another or to stick to an inner wall of the apparatus. In such a case, it is preferable to decrease the supply rate of the coating liquid. On the other hand, in the case where the supply rate of the coating liquid is too slow, it requires too much time for the treatment. Thus, it is preferable to increase the supply rate of the coating liquid within a range which does not generate aggregation or sticking of the solid bleaching agent. In this way, the supply rate of the coating liquid can be set appropriately. Furthermore, a degree of aggregation also varies depending on a type of a compound used in the coating layer. Thus, it is preferable to select a compound which hardly aggregates in the coating layer. As described above, by appropriately adjusting the intensity at the flowable state of the solid bleaching agent and the supply rate of the coating liquid within the respective ranges which do not destroy the solid bleaching agent and do not cause aggregation or sticking, it is possible to produce the solid bleaching agent-containing material having a coating layer of the present invention.

In order to evaluate how much fine pulverization or aggregation occurred during processing of the solid bleaching agent-containing material having a coating layer, a decrease rate or increase rate of the average particle diameter of the solid bleaching agent-containing material having a coating layer after processing, with respect to the average particle diameter of the solid bleaching agent used as a raw material, is defined as an aggregation rate according to the following Expression (8).

[Math. 8]

$$\text{Aggregation rate (\%)} = D1 \times 100 / D2 \qquad \text{(Expression 8)}$$

D1: Average particle diameter of solid bleaching agent-containing material having coating layer after processing D2: Average particle diameter of solid bleaching agent used as raw material The aggregation rate is preferably 80% or higher and 300% or lower, more preferably 85% or higher and 250% or lower, and even more preferably 90% or higher and 200% or lower. The case where the aggregation rate is 80% or higher is preferable because, during processing, a coating layer of the solid bleaching agent can be formed, while fine pulverization of both of or any one of the coating layer and the solid bleaching agent is within an allowable range. The case of 85% or more is more preferable because a degree of fine pulverization is smaller, and the case of 90% or more is even more preferable because a degree of fine pulverization is even smaller. On the other hand, the case where the aggregation rate is 300% or less is preferable because progress of aggregation of particles during processing is within an allowable range and thus, handling becomes easy in such a case of being blended with a detergent composition. The case of 250% or less is more preferable because handling becomes easier, and the case of 200% or less is even more preferable because handling becomes even easier.

A stability of the solid bleaching agent-containing material having a coating layer thus obtained can be evaluated on the basis of how much an effective chlorine retention rate or effective oxygen retention rate after a storage test under certain conditions is improved before and after coating. The effective chlorine retention rate (%) is defined by the following Expression 9. The effective chlorine retention rate (%) closer to 100% means that the solid bleaching agent is more stable; while that closer to 0% means that the solid bleaching agent is more unstable. Similarly, in the case where the solid bleaching agent is an oxygen bleaching agent, the stability of the solid bleaching agent is defined by the effective oxygen retention rate (%). In the case where the solid bleaching agent-containing material having a coating layer and a solid bleaching agent having no coating layer are subjected to a storage test under the same condition, respectively, it can be said that the stability of the solid bleaching agent is improved if the solid bleaching agent-containing material having a coating layer exhibits a higher effective chlorine retention rate or effective oxygen retention rate as compared with the solid bleaching agent having no coating layer.

[Math. 9]

$$\text{Effective chlorine or effective oxygen retention rate (\%)} = R1 \times 100 / R2 \qquad \text{(Expression 9)}$$

R1: Effective chlorine or effective oxygen content (%) of solid bleaching agent or solid bleaching agent-containing material after storage test R2: Effective chlorine or effective oxygen content (%) of solid bleaching agent or solid bleaching agent-containing material before storage test The following method can be adopted as a condition of the storage test for evaluating the stability of the solid bleaching agent.

For example, when the solid bleaching agent-containing material having a coating layer of the present invention and the bleaching agent having no coating layer are stored for a certain period of time under an environment where factors that cause deterioration, deactivation or decomposition of the solid bleaching agent exist, a difference appears in stability of the solid bleaching agent. In that case, there are no particular limitations on factors that cause deterioration, deactivation or decomposition of the solid bleaching agent, and examples thereof include acidity, basicity, high temperature, and high humidity.

The storage test may be carried out with the solid bleaching agent being mixed with other compounds. As the other compounds, one or more selected from the group of the above-described organic substances, inorganic substances and mixtures thereof may be used. For example, the storage test may be carried out by storing only the solid bleaching agent-containing material having a coating layer at high temperature and high humidity for a certain period of time, or the storage test may be carried out by blending the solid bleaching agent-containing material having a coating layer with a detergent composition and storing the detergent composition for a certain period of time. In addition, the storage test may be carried out after giving a physical impact to the solid bleaching agent-containing material having a coating layer in advance, or being subjected to a step such as stirring or mixing together with the above-mentioned detergent composition.

In addition, in the storage test, a temperature, humidity and packaging form during storage can be appropriately changed. For example, the storage test may be carried out under a condition of normal temperature and normal pressure or under an environment with, for example, a temperature of 40° C. and a relative humidity of 75% by controlling temperature and humidity. In addition, the solid bleaching agent-containing material to be tested may be used as it is, or used by being put in a film or container.

In the case where the solid bleaching agent-containing material having a coating layer exhibits a higher effective chlorine retention rate or effective oxygen retention rate as compared with the solid bleaching agent having no coating layer after completion of the storage test under such a condition, it can be said that a stability of the solid bleaching agent is improved. A higher effective chlorine retention rate or effective oxygen retention rate means that the solid bleaching agent maintains effects of washing, sterilization and bleaching after storage. How much the stability of the solid bleaching agent is improved may depend not only on a nature of the solid bleaching agent-containing material having a coating layer, but also on a condition setting of the storage test. Depending on an application and use condition of the solid bleaching agent, conditions of the storage test can be set even in a range other than the conditions described in the present specification. It is preferable that the stability of the solid bleaching agent is improved regardless of the storage test to a degree that conforms to the application or use condition.

EXAMPLES

Hereinafter, the present invention will be specifically described with reference to Examples and Comparative Examples, but the present invention is not limited thereto.

Hereinafter, main agents used in the experiments will be explained.

- Sodium benzoate, sodium para-t-butylbenzoate, ortho-phthalic acid, meta-phthalic acid, para-phthalic acid, and trimellitic acid: manufactured by Wako Pure Chemical Industries, Ltd. (reagents)
- Disodium ortho-phthalate, disodium meta-phthalate, disodium para-phthalate, and trisodium trimellitate: which were prepared by dissolving ortho-phthalic acid, meta-phthalic acid, para-phthalic acid, and trimellitic acid, respectively, in an aqueous sodium hydroxide solution.
- Sodium formate, sodium acetate, sodium propionate, sodium butyrate, valeric acid, hexanoic acid, heptanoic acid, octanoic acid, and decanoic acid: manufactured by Wako Pure Chemical Industries, Ltd. (reagents)
- Sodium valerate, sodium hexanoate, sodium heptanoate, and sodium decanoate: which were prepared by dissolving valeric acid, hexanoic acid, heptanoic acid, octanoic acid, and decanoic acid, respectively, in an aqueous sodium hydroxide solution.
- Succinic acid, adipic acid, azelaic acid, sebacic acid, and dodecanedioic acid: manufactured by Wako Pure Chemical Industries, Ltd. (reagents)
- Glutaric acid, pimelic acid, suberic acid, and tetradecanedioic acid: manufactured by Tokyo Chemical Industry Co., Ltd. (reagents)
- Disodium succinate, disodium glutarate, disodium adipate, disodium pimelate, disodium suberate, disodium azelate, disodium sebacate, disodium dodecanedioate, and disodium tetradecanedioate: which were prepared by dissolving succinic acid, glutaric acid, adipic acid, pimelic acid, suberic acid, azelaic acid, sebacic acid, dodecanedioic acid, and tetradecanedioic acid, respectively, in an aqueous sodium hydroxide solution.
- Sodium hydroxide: manufactured by Wako Pure Chemical Industries, Ltd. (reagent)
- Myristic acid: manufactured by Wako Pure Chemical Industries, Ltd. (reagent)
- Sodium alkylbenzenesulfonate: "LIPON (registered trademark) PS-230" manufactured by Lion Corporation
- Sodium lauryl sulfate: "EMAL (registered trademark) 10PT" manufactured by Kao Corporation
- Silicone antifoaming agent: "KM-89" manufactured by Shin-Etsu Chemical Co., Ltd.
- Sodium α-olefin sulfonate: "LIPOLAN (registered trademark) PB-800" manufactured by Lion Corporation
- Hydroxypropyl cellulose: manufactured by Wako Pure Chemical Industries, Ltd. (reagent)
- Sodium octanoate and sodium laurate: manufactured by Wako Pure Chemical Industries, Ltd. (reagents)
- Sodium hydrogen carbonate and sodium sulfate: manufactured by Wako Pure Chemical Industries, Ltd. (reagents)
- Paraffin wax (melting point of from 58 to 60° C.): manufactured by Wako Pure Chemical Industries, Ltd. (reagent)
- Stearyl alcohol: manufactured by Wako Pure Chemical Industries, Ltd. (reagent)
- Fine zeolite (synthetic zeolite A-4 with average particle diameter of from 2 to 5 μm): manufactured by Wako Pure Chemical Industries, Ltd. (reagent)
- Sodium dichloroisocyanurate: "NEOCHLOR (registered trademark) 60G" (average particle diameter of 700 μm) manufactured by Shikoku Chemicals Corporation
- Trichloroisocyanuric acid: "NEOCHLOR 90G" (average particle diameter of 1,097 μm) manufactured by Shikoku Chemicals Corporation
- Sodium percarbonate (sodium carbonate-hydrogen peroxide adduct): "PC-2" (average particle diameter of 746 μm) manufactured by ADEKA CORPORATION
- Peroxysulfuric acid-sulfuric acid-penta-potassium salt: "OXONE (registered trademark)" (average particle diameter of 516 μm) manufactured by Kemers Co., Ltd.
- Mixed product of bromochloro-5,5-dimethylhydantoin, 1,3-dichloro-5,5-dimethylhydantoin, and 1,3-dichloro-5,5-ethylmethylhydantoin (hereinafter referred to as a halogenated hydantoin mixture): "DANTOBROM RW" (average particle diameter of 886 μm) manufactured by Lonza Japan Co., Ltd.
- Sodium metasilicate: manufactured by Sigma-Aldrich Corporation (reagent)
- Sodium metasilicate pentahydrate: manufactured by Sigma-Aldrich Corporation (reagent)
- Sodium metasilicate nonahydrate: manufactured by Sigma-Aldrich Corporation (reagent)
- Trisodium nitrilotriacetate monohydrate: manufactured by Wako Pure Chemical Industries, Ltd. (reagent)
- Potassium carbonate: manufactured by Wako Pure Chemical Industries, Ltd. (reagent)

Potassium sulfate: manufactured by Wako Pure Chemical Industries, Ltd. (reagent)

Olefin-anhydrous sodium maleate copolymer: "ACUSOL (registered trademark) 460ND" manufactured by Rohm & Haas Co., Ltd.

Ethylene diamine-polyoxyethylene-polyoxypropylene block polymer: "ADEKA PLURONIC TR-702" manufactured by ADEKA CORPORATION Ethanol: "Special grade reagent" manufactured by Wako Pure Chemical Industries, Ltd.

As other reagents and instruments, ordinarily available ones for general purpose were used.

Example 1

As a solid bleaching agent, sodium dichloroisocyanurate was used. Into a processing apparatus "DPZ-01" (manufactured by AS ONE Corporation) was charged 100 g of sodium dichloroisocyanurate, and the sodium dichloroisocyanurate was maintained in a flowable state while heating with a revolution rate of the rotating pan set to 40 rpm, an elevation angle set to 45°, and a heater temperature set to be Hi. Here, the elevation angle refers to an angle formed by a rotation axis direction of the rotating pan and a horizontal direction. At this time, as the revolution rate is faster and the elevation angle is smaller, the sodium dichloroisocyanurate in a flowable state moves vigorously, and therefore it can be said that the intensity at the flowable state is strong. The revolution rate, elevation angle and heater temperature can be appropriately modulated within a range in which flow of the solid bleaching agent can be maintained. That is, modulation has to be done to cause the solid bleaching agent to be uniformly wet with a sprayed coating solution. For example, in the case where the solid bleaching agent accumulates under the rotating pan and flow is insufficient, by increasing the revolution rate or increasing the elevation angle, the solid bleaching agent is caused to easily spread over the whole rotating pan. On the other hand, in the case where the revolution rate of the rotating pan is too high or the elevation angle is too large, the solid bleaching agent accumulates in a circumferential direction due to a centrifugal force of the rotating pan and flow becomes insufficient. Thus, by slowing the revolution rate or decreasing the elevation angle, it is possible to make the solid bleaching agent flow again so that it spreads over the whole rotating pan.

On the sodium dichloroisocyanurate in the flowable state was sprayed 25% by mass sodium benzoate aqueous solution (coating liquid) to wet the sodium dichloroisocyanurate. At this time, the coating liquid was fed by a tube pump at a rate of spraying speed of about 1 g/min. A silicone tube having an inner diameter of 2 mm was used for feeding the coating liquid. At the time of spraying, compressed air of 0.1 MPa was introduced into a spray nozzle by a polyethylene tube having an inner diameter of 2 mm. A two-fluid nozzle (model AM25, manufactured by Atmax Co., Ltd.) was used as the spray nozzle, and the compressed air of 0.1 MPa was supplied to splash the coating liquid. Since the rotating pan was heated, water in the coating liquid wetting the sodium dichloroisocyanurate was dried and removed, and a coating layer of sodium benzoate was gradually formed on a surface of the sodium dichloroisocyanurate. The operation was terminated at a point where 342 g of the coating liquid was sprayed, and 176 g of a sample of solid bleaching agent-containing material with the coating layer containing sodium benzoate was obtained. In the case where a type and amount of compounds used for the solid bleaching agent and coating layer are changed, processing conditions can be appropriately changed.

Moisture Content

When the whole amount of the prepared sample was dried in an oven set at 110° C., it reached a constant weight in 1.5 hours and the weight at that time was 163 g. Thus, an amount of moisture immediately after processing (hereinafter sometimes referred to as "moisture content") remaining in the sample was calculated to be 7.4% by mass as shown in Table 1. Based on the weight after drying, a yield determined from weights of the solid bleaching agent and coating material used was 88%.

Effective Chlorine Content and Proportion of Coating Layer

The sample after drying was weighed in a range of from 0.10 to 0.13 g, and put in a 200 ml conical beaker after the mass thereof was accurately recorded up to 4 decimal places. Distilled water was added thereto to be about 100 ml, and about 1 g potassium iodide and about 5 ml of a 50% by mass acetic acid aqueous solution were further added and stirred for about 5 minutes. The liberated iodine was titrated with a 0.1 N sodium thiosulfate aqueous solution. After a yellow color of the solution became thin, approximately 1 ml of an aqueous solution of starch (10 g/L) was added as an indicator and the titration was continued until a blue color of the generated iodine-starch disappeared. The effective chlorine content (%) was determined from the titration amount of the sodium thiosulfate aqueous solution. As a result, the effective chlorine content of the sample after drying was 38.0%. At this time, the effective chlorine content of the sodium dichloroisocyanurate used as a raw material was slightly lower than a theoretical value and was 62.5%, so that a proportion occupied by the coating layer in the sample after drying was calculated to be 39% by mass as shown in Table 1. That is, the sample after drying was considered to be a solid bleaching agent-containing material having a coating layer composed of sodium benzoate in which the coating layer occupies 39% by mass of the whole weight. In the case where a type and amount of compounds used for the solid bleaching agent and coating layer are changed, processing conditions can be appropriately changed.

Example 2

As a solid bleaching agent, 500 g of sodium dichloroisocyanurate was used. The sodium dichloroisocyanurate was input into a processing apparatus "Spir-A-Flow" (model SFC-MINI, manufactured by Freund Industrial Co., Ltd.). An opening degree of an exhaust damper was set to 7.5, an opening degree of a flowing air damper was set to 6, an opening degree of a slit air damper was set to 7, and a temperature of a supply air heater was set to 100° C. The revolution rate of a rotor was set at 300 rpm, and the apparatus was operated to bring the sodium dichloroisocyanurate into a flowable state. At this time, as the opening degree of each damper of the exhaust damper, flowing air and slit air is large and the revolution rate of the rotor is fast, the sodium dichloroisocyanurate moves vigorously, and therefore it can be said that the intensity at the flowable state is strong.

At a time point where the temperature of the sodium dichloroisocyanurate in a flowable state reached 60° C., a 36% by mass sodium benzoate aqueous solution (coating liquid) was sprayed at a rate of spraying speed of about 20 g/min. At the time of spraying the coating liquid, compressed air of 0.1 MPa was supplied at a flow rate of 20

L/min. The temperature of the sodium dichloroisocyanurate is measured by a thermometer installed inside and is indicated as a product temperature. A feed rate of the coating liquid was finely adjusted so that the product temperature was in a range of 60° C.±10° C. As a spray nozzle, a two-fluid nozzle (model ATU-MINI, manufactured by Freund Industrial Co., Ltd.) was used. The processing was terminated at a time point where 540 g of the coating liquid was sprayed, and 692 g of a sample of solid bleaching agent-containing material was obtained. The sample after processing was taken out of the apparatus. The sample reached a constant weight at a time point where it was dried in a dryer at 110° C. for 1.5 hours. In the case where a type and amount of compounds used for the solid bleaching agent and coating layer are changed, processing conditions can be appropriately changed.

The moisture content, effective chlorine content, yield and proportion of the coating layer were calculated in the same manner as in Example 1 (hereinafter the same). As a result, as shown in Table 1, from the fact that the moisture content was 1.9% by mass and the effective chlorine content was 46.3%, the proportion of the coating layer was 26% by mass.

Stability Test 1 (Storage Test)

A storage test was carried out by using sodium dichloroisocyanurate as an unprocessed solid bleaching agent and using the samples that were prepared in Example 1 and Example 2 and dried at 110° C. for 1.5 hours as solid bleaching agent-containing materials having a coating layer. In a glass beaker having a volume of 50 ml were mixed and put 3 g of anhydrous sodium metasilicate, 2.0 g of potassium carbonate, 4.75 g of trisodium nitrilotriacetate monohydrate, 0.1 g of ethylenediamine-polyoxyethylene-polyoxypropylene block polymer, and 0.15 g of the solid bleaching agent or solid bleaching agent-containing material, thereto was further added 3 ml of tap water at 60° C., and the mixture was gently stirred by a spatula so as to draw a circle. At this time, room temperature was 20° C. and relative humidity was 40%. After allowing to stand for 18 hours at the room temperature as it was, the whole mixture was dissolved in 200 ml of distilled water, and an effective chlorine content was measured to calculate an effective chlorine retention rate. The case where the effective chlorine retention rate (effective chlorine retention rate after coating) in the case of using the solid bleaching agent-containing material having a coating layer was improved as compared with the effective chlorine retention rate (effective chlorine retention rate before coating) in the case of using the unprocessed solid bleaching agent can be said that a stability of the solid bleaching agent is improved, and therefore was evaluated as pass which is denoted by A. The case of no improvement or the case of decrease cannot be said that a stability of the solid bleaching agent is improved, and therefore was evaluated as failed which is denoted by B. After the storage test, effective chlorine retention rates of the sodium dichloroisocyanurate before coating and the samples prepared in Example 1 and Example 2 were, respectively, as shown in Table 10.

Foamability Test (Evaluation of Foaming Properties)

The solid bleaching agent-containing materials having a coating layer which had been prepared in Example 1 and Example 2 and dried at 110° C. for 1.5 hours, were respectively dissolved in water so as to have a concentration of 0.2% by mass, to prepare aqueous solutions, and 20 ml of the obtained aqueous solutions were respectively put in a colorimetric tube having a volume of 100 ml. The colorimetric tube was allowed to stand in a constant temperature water bath at 60° C. for 30 minutes, and then the colorimetric tube was shaken vigorously up and down ten times with both hands while holding down a lid of the colorimetric tube. An amount of foam immediately after shaking was read from a scale of the colorimetric tube and a foaming amount was evaluated. In the evaluation results of the foaming amount, the case where foaming did not occur or less than 1 ml of foam was generated was evaluated as pass which is denoted by A. The case where foam was generated and foam was 1 ml or more and less than 30 ml in the scale of the colorimetric tube was evaluated as failed which is denoted by B because foam was generated. The case of 30 ml or more was evaluated as failed which is denoted by C because foam was further excessively large amount. The results are as shown in Table 10. Since a volume of the colorimetric tube is 100 ml, a measurable amount of foam is up to 80 ml. Therefore, in the case where the foaming amount exceeds 80 ml, the foam amount is expressed as "80<".

Solubility Test (Residue Evaluation)

The solid bleaching agent-containing material was dissolved in 100 ml of water at 40° C. so as to achieve the concentration of 0.2% by mass and 5% by mass, and undissolved residues were visually evaluated. In the case where undissolved residues were present, stirring was continued for 30 minutes or more and then evaluation was performed. The case where there were no residues derived from an undissolved coating layer on a water surface and a water bottom at both concentrations was evaluated as pass which is denoted by A. The case where there were no residues derived from an undissolved coating layer on a water surface and a water bottom at the concentration of 0.2% by mass but there were residues derived from the undissolved coating layer on the water surface and the water bottom at the concentration of 5% by mass was evaluated as failed which is denoted by B. The case where there were residues derived from the undissolved coating layer on the water surface and the water bottom at both concentrations was evaluated as failed which is denoted by C. The results were as shown in Table 10.

Examples 3 to 7

In the same manner as in Example 2 except for the conditions described in Table 1, samples of a solid bleaching agent-containing material having a coating layer were prepared by using sodium para-t-butylbenzoate, disodium ortho-phthalate, disodium meta-phthalate, disodium para-phthalate, and trisodium trimellitate, respectively, for the coating layer. The concentration (% by mass) of the coating liquid, moisture content (% by mass) of each of the prepared samples and proportion (% by mass) of the coating layer were as shown in Table 1. For each sample, in the same manner as in the cases of Example 1 and Example 2, the stability test 1, foamability test and solubility test were carried out by using samples after drying at 110° C. for 1.5 hours. The results were as shown in Table 10.

Examples 8 to 16

In the same manner as in Example 1 or Example 2 except for the conditions described in Table 2, samples of a solid bleaching agent-containing material having a coating layer were prepared by using disodium succinate, disodium glutarate, disodium adipate, disodium pimelate, disodium suberate, disodium azelate, disodium sebacate, disodium dodecanedioate, and disodium tetradecanedioate, respectively, for the coating layer. The concentration (% by mass) of the coating liquid, moisture content (% by mass) of each of the prepared samples and proportion (% by mass) of the coating layer were as shown in Table 2. For each sample, in the same manner as in the cases of Example 1 and Example 2, the stability test 1, foamability test and solubility test were carried out by using samples after drying at 110° C. for 1.5 hours. The results were as shown in Table 11.

Examples 17 to 23

In the same manner as in Example 1 or Example 2 except for the conditions described in Table 3, samples of a solid bleaching agent-containing material having a coating layer were prepared by using sodium formate, sodium acetate, sodium propionate, sodium butyrate, sodium valerate, sodium hexanoate, and sodium heptanoate, respectively, for the coating layer. The concentration (% by mass) of the coating liquid, moisture content (% by mass) of each of the prepared samples and proportion (% by mass) of the coating layer were as shown in Table 3. For each sample, in the same manner as in the cases of Example 1 and Example 2, the stability test 1, foamability test and solubility test were carried out by using samples after drying at 110° C. for 1.5 hours. The results were as shown in Table 12.

Examples 24 to 29

In the same manner as in Example 2 except for the conditions described in Table 4, samples of a solid bleaching agent-containing material having a coating layer were prepared by using two types of compounds so that the coating layer further contained two layers. That is, as a first step, a solid bleaching agent-containing material having a coating layer was prepared by using sodium benzoate for the coating layer, and as a second step, a further coating layer was formed by using disodium sebacate or disodium dodecanedioate on the solid bleaching agent-containing material having a coating layer, which had been prepared in the first step, to thereby prepare samples of a solid bleaching agent-containing material having a coating layer including an inner layer composed of sodium benzoate and an outer layer composed of disodium sebacate or disodium dodecanedioate. The concentration (% by mass) of the coating liquid, moisture content (% by mass) of each of the prepared samples and proportion (% by mass) of the coating layer were as shown in Table 4. For each sample, in the same manner as in the cases of Example 1 and Example 2, the stability test 1, foamability test and solubility test were carried out by using the sample after drying at 110° C. for 1.5 hours. The results were as shown in Table 13. In Examples 24 to 29, the proportion of the coating layer was quantified by high performance liquid chromatography (HPLC). Hereinafter, the quantifying method will be described in detail.

As an apparatus, a high performance liquid chromatograph LC-2010 AHT (manufactured by Shimadzu Corporation) was used. As a column, HITACHI LaChrom (registered trademark) C18-AQ (manufactured by Hitachi High-Tech Sciences Co., Ltd.), which is a column for a high performance liquid chromatograph, was used. As a mobile phase, a solvent in which a diammonium hydrogenphosphate aqueous solution that had been adjusted to have a concentration of 60 mM and methanol were mixed so as to be a weight ratio of 9:1 was used. A flow rate of the mobile phase was set at 1 ml/min and a temperature setting of a column oven was at 40° C. Ultraviolet rays with a wavelength of 210 nm were used for detection. Under the conditions thus set, a calibration curve was prepared for a relationship between a peak area and concentration by using an aqueous solution of sodium dichloroisocyanurate (provided that effective chlorine was neutralized with an equivalent amount of sodium sulfite), an aqueous solution of sodium benzoate, and an aqueous solution of disodium sebacate, which all had known concentrations. At this time, a peak derived from sodium dichloroisocyanurate was detected at a retention time of around 3.0 minutes, a peak derived from sodium benzoate was detected at a retention time of around 8.0 minutes, and a peak derived from disodium sebacate was detected at a retention time of around 11.5 minutes.

Samples prepared in Examples 24 to 29 of known concentrations were measured under the same conditions as in the above HPLC, and sodium dichloroisocyanurate, sodium benzoate and sodium sebacate were respectively quantified to calculate the proportion (% by mass) of the coating layer according to Expression 6. With respect to the samples containing disodium dodecandioate prepared in Examples 27 to 29, only sodium dichloroisocyanurate and sodium benzoate were quantified, and in Expression 7, Q2 was taken as the entire amount, Q3 was taken as a total amount of sodium dichloroisocyanurate and sodium benzoate, and remaining Q1 was regarded as disodium dodecanedioate, so that contents of the respective components were obtained.

Examples 30 to 35

In the same manner as in Example 2 except for the conditions described in Table 5, samples of a solid bleaching agent-containing material having a coating layer in which the coating layer was composed of a mixture of two types of compounds were prepared. That is, a mixed solution composed of sodium benzoate as a first component of the coating liquid and disodium sebacate or disodium dodecanedioate as a second component was used to prepare a solid bleaching agent-containing material having a coating layer in which the coating layer is composed of a mixture of sodium benzoate and disodium sebacate, or sodium benzoate and disodium dodecanedioate. The concentration (% by mass) of the coating liquid, moisture content (% by mass) of each of the prepared samples and proportion (% by mass) of the coating layer were as shown in Table 5. The proportion of the coating layer was quantified by HPLC in the same manner as in the cases of Examples 24 to 29. For each sample, in the same manner as in the cases of Example 1 and Example 2, the stability test 1, foamability test and solubility test were carried out by using the sample after drying at 110° C. for 1.5 hours. The results were as shown in Table 14.

Examples 36 and 37

In the same manner as in Examples 24 to 29 except for the conditions described in Table 6, samples of a solid bleaching agent-containing material having a coating layer were prepared by using two types of compounds so that the coating layer further contained two layers. That is, as a first step, a solid bleaching agent-containing material having a coating layer was prepared by using sodium benzoate for the coating layer, and as a second step, a further coating layer was formed by using sodium octanoate or sodium decanoate on the solid bleaching agent-containing material having a coating layer, which had been prepared in the first step, to thereby prepare samples of a solid bleaching agent-containing material having a coating layer including an inner layer composed of sodium benzoate and an outer layer composed of sodium octanoate or sodium decanoate. The concentration (% by mass) of the coating liquid, moisture content (% by mass) of each of the prepared samples and proportion (% by mass) of the coating layer were as shown in Table 6. The proportion of the coating layer was quantified by HPLC in the same manner as in the cases of Examples 24 to 29. For each sample, in the same manner as in the cases of Example 1 and Example 2, the stability test 1, foamability test and solubility test were carried out by using the sample after drying at 110° C. for 1.5 hours. The results were as shown in Table 15.

As such, even compounds other than one or more compounds selected from the group consisting of alkali metal salts of aromatic carboxylic acids, alkali metal salts of acyclic dicarboxylic acids, alkali metal salts of acyclic monocarboxylic acids having a carbon number of from 1 to 7, and mixtures thereof can be contained in the coating layer within a range which does not impair effects of the present invention.

Examples 38 and 39

In the same manner as in Examples 30 to 35 except for the conditions described in Table 7, samples of a solid bleaching agent-containing material having a coating layer in which the coating layer is composed of a mixture of two types of compounds were prepared. That is, a mixed solution of sodium benzoate and sodium octanoate or a mixed solution of sodium benzoate and sodium decanoate was used as a coating liquid to prepare a solid bleaching agent-containing material having a coating layer in which the coating layer was composed of a mixture of sodium benzoate and sodium octanoate or a mixture of sodium benzoate and sodium decanoate. The concentration (% by mass) of the coating liquid, moisture content (% by mass) of each of the prepared samples and proportion (% by mass) of the coating layer were as shown in Table 7. The proportion of the coating layer was quantified by HPLC in the same manner as in the cases of Examples 24 to 29. For each sample, in the same manner as in the cases of Example 1 and Example 2, the stability test 1, foamability test and solubility test were carried out by using the sample after drying at 110° C. for 1.5 hours. The results were as shown in Table 16.

Comparative Examples 1 to 8

In the same manner as in Example 1 or Example 2 except for the conditions described in Table 8, samples of a solid bleaching agent-containing material having a coating layer were prepared by using sodium lauryl sulfate, sodium alkylbenzene sulfonate, sodium α-olefin sulfonate, hydroxypropyl cellulose, sodium laurate, sodium octanoate, sodium hydrogen carbonate, and sodium sulfate, respectively, for the coating layer. In the case where a spraying speed during processing is too fast, there may be cases where particles aggregate with one another, or the solid bleaching agent sticks to an inner wall of the apparatus. In such a case, aggregation or sticking can be avoided by slowing a supply rate of the coating liquid. The aggregated and stuck particles may be loosened by using a soft tool such as a rubber spatula so that the particles are not destroyed. The concentration (% by mass) of the coating liquid, moisture content (% by mass) of each of the prepared samples and proportion (% by mass) of the coating layer were as shown in Table 8. For each sample, in the same manner as in the cases of Example 1 and Example 2, the stability test 1, foamability test and solubility test were carried out by using the sample after drying at 110° C. for 1.5 hours. The results were as shown in Table 17.

Comparative Example 9

In the same manner as in Example 1 except that an ethanol solution of myristic acid which had been modulated to have a concentration of 22% by mass was sprayed on the sodium dichloroisocyanurate in a flowable state, to wet the sodium dichloroisocyanurate, and except for the conditions described in Table 9, a sample of a solid bleaching agent-containing material having a coating layer was prepared by using myristic acid for the coating layer. The concentration (% by mass) of the coating liquid and proportion (% by mass) of the coating layer were as shown in Table 9. Since water was not used in the solvent, a drying step was not provided and a moisture content was not measured. For the sample prepared in Comparative Example 9, in the same manner as in the cases of Example 1 and Example 2, the stability test 1, foamability test and solubility test were carried out. The results were as shown in Table 18.

Comparative Example 10

A coating liquid in which sodium lauryl sulfate was dissolved so as to be 24% by mass and silicone antifoaming agent (KM-89) was dispersed so as to be 5% by mass (having a concentration of coating materials of 29% by mass in total) was prepared. In the same manner as in Example 1 except that this coating liquid was sprayed to wet the sodium dichloroisocyanurate, and except for the conditions described in Table 9, a sample of a solid bleaching agent-containing material in which the coating layer was composed of a mixture of sodium lauryl sulfate and the silicone antifoaming agent was prepared. The concentration (% by mass) of the coating liquid, moisture content (% by mass) of the prepared sample and proportion (% by mass) of the coating layer were as shown in Table 9. For the sample prepared in Comparison Example 10, in the same manner as in the cases of Example 1 and Example 2, the stability test 1, foamability test and solubility test were carried out by using the sample after drying at 110° C. for 1.5 hours. The results were as shown in Table 18.

Comparative Example 11

Into a processing apparatus "DPZ-01" (manufactured by AS ONE Corporation) was charged 70 g of sodium dichloroisocyanurate, and the sodium dichloroisocyanurate was maintained in a flowable state while heating with a revolution rate of the rotating pan set to 40 rpm, an elevation angle set to 45°, and a heater temperature set to be Hi. A thermometer was inserted into the sodium dichloroisocyanurate in the flowable state, and at a time point where the thermometer indicated 68° C., a power of the heater was turned OFF and 12 g of paraffin wax (melting point of from 58 to 60° C.) heated to 68° C. was added dropwise by a pipette over about 30 seconds so as to sprinkle on the sodium dichloroisocyanurate in the flowable state. From the start of dropwise addition, a rubber spatula was inserted into a flowing portion of the sodium dichloroisocyanurate to act as a baffle to promote mixing. Stirring was continued for about 30 seconds after completion of the dropwise addition. Then, 18 g of fine zeolite heated to 46° C. was added and mixed for about 20 seconds. Air not warmed was blown with a hair dryer to cool the sample. A thermometer was inserted into the sample in a flowable state, and cooled to 40° C. or less to obtain 98 g of the sample. The proportion (% by mass) of the coating layer was as shown in Table 9. Since water was not used in the solvent, a drying step was not provided and a moisture content was not measured. For the sample prepared in Comparative Example 11, in the same manner as in the cases of Example 1 and Example 2, the stability test 1, foamability test and solubility test were carried out. The results were as shown in Table 18.

Comparative Example 12

In the same manner as in Comparative Example 11, a sample of 95 g was prepared by using 61 g of sodium dichloroisocyanurate as a solid bleaching agent and using 13 g of stearyl alcohol (melting point of 59° C.) and 26 g of fine zeolite as a coating layer. The proportion (% by mass) of the coating layer was as shown in Table 9. Since water was not used in the solvent, a drying step was not provided and a moisture content was not measured. For the sample prepared in Comparative Example 12, in the same manner as in the cases of Example 1 and Example 2, the stability test 1, foamability test and solubility test were carried out. The results were as shown in Table 18.

TABLE 1

| | Example | | | | | | |
|---|---|---|---|---|---|---|---|
| | 1 | 2 | 3 | 4 | 5 | 6 | 7 |
| Apparatus used | DPZ-01 | SFC-MINI | SFC-MINI | SFC-MINI | SFC-MINI | SFC-MINI | SFC-MINI |
| Type of solid bleaching agent | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate |
| Charging amount of solid bleaching agent (g) | 100 | 500 | 500 | 500 | 500 | 500 | 500 |
| Coating layer | Sodium benzoate | Sodium benzoate | Sodium para-t-butylbenzoate | Disodium ortho-phthalate | Disodium meta-phthalate | Disodium para-phthalate | Trisodium trimellitate |
| Concentration of coating liquid (mass %) | 25 | 36 | 25 | 25 | 25 | 10 | 25 |
| Spraying amount (g) | 342 | 540 | 777 | 777 | 777 | 1,943 | 777 |
| Spraying speed (g/min) | 1 | 20 | 20 | 21 | 21 | 20 | 20 |
| Yield amount (g) | 176 | 692 | 699 | 740 | 749 | 671 | 767 |
| Yield (%) | 88 | 98 | 97 | 99 | 100 | 90 | 100 |
| Proportion of coating layer (mass %) | 39 | 26 | 25 | 26 | 28 | 25 | 28 |
| Average particle diameter (μm) | 913 | 859 | 1,015 | 842 | 1,035 | 671 | 1,158 |
| Aggregation rate (%) | 130 | 123 | 145 | 120 | 148 | 96 | 165 |
| Moisture amount immediately after processing (mass %) | 7.4 | 1.9 | 3.6 | 6.8 | 6.1 | 7.0 | 6.7 |

TABLE 2

| | Example | | | | |
|---|---|---|---|---|---|
| | 8 | 9 | 10 | 11 | 12 |
| Apparatus used | DPZ-01 | DRZ-01 | DPZ-01 | DPZ-01 | SFC-MINI |
| Type of solid bleaching agent | Sodium dichloro-isocyanurate | Sodium dichloro-isocyanurate | Sodium dichloro-isocyanurate | Sodium dichloro-isocyanurate | Sodium dichloro-isocyanurate |
| Charging amount of solid bleaching agent (g) | 100 | 100 | 100 | 100 | 500 |
| Coating layer | Disodium succinate | Disodium glutarate | Disodium adipate | Disodium pimelate | Disodium suberate |
| Concentration of coating liquid (mass %) | 20 | 25 | 10 | 25 | 75 |
| Spraying amount (g) | 575 | 222 | 667 | 220 | 747 |
| Spraying speed (g/min) | 1 | 1 | 1 | 1 | 16 |
| Yield amount (g) | 145 | 153 | 146 | 152 | 676 |
| Yield (%) | 64 | 95 | 83 | 88 | 97 |
| Proportion of coating layer (mass %) | 35 | 39 | 34 | 33 | 26 |
| Average particle diameter (μm) | 813 | 1,029 | 967 | 945 | 813 |
| Aggregation rate (%) | 116 | 147 | 138 | 135 | 116 |
| Moisture amount immediately after processing (mass %) | 4.6 | 3.5 | 5.6 | 10 | 1.6 |

| | Example | | | |
|---|---|---|---|---|
| | 13 | 14 | 15 | 16 |
| Apparatus used | SFC-MINI | SFC-MINI | DPZ-01 | DPZ-01 |
| Type of solid bleaching agent | Sodium dichloro-isocyanurate | Sodium dichloro-isocyanurate | Sodium dichloro-isocyanurate | Sodium dichloro-isocyanurate |

TABLE 2-continued

| | | | | |
|---|---|---|---|---|
| Charging amount of solid bleaching agent (g) | 500 | 500 | 100 | 100 |
| Coating layer | Disodium azelate | Disodium sebacate | Disodium dodecane-dioate | Disodium tetradecane-dioate |
| Concentration of coating liquid (mass %) | 25 | 20 | 8.6 | 6.6 |
| Spraying amount (g) | 780 | 925 | 625 | 830 |
| Spraying speed (g/min) | 16 | 16 | 1.5 | 1 |
| Yield amount (g) | 718 | 667 | 137 | 122 |
| Yield (%) | 99 | 96 | 86 | 76 |
| Proportion of coating layer (mass %) | 27 | 26 | 31 | 21 |
| Average particle diameter (μm) | 1,009 | 722 | 713 | 712 |
| Aggregation rate (%) | 144 | 103 | 102 | 102 |
| Moisture amount immediately after processing (mass %) | 4.0 | 1.0 | 3.4 | 3.2 |

TABLE 3

| | Example | | | | | | |
|---|---|---|---|---|---|---|---|
| | 17 | 18 | 19 | 20 | 21 | 22 | 23 |
| Apparatus used | DPZ-01 | SFC-MINI | SFC-MINI | SFC-MINI | SFC-MINI | SFC-MINI | SFC-MINI |
| Type of solid bleaching agent | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate |
| Charging amount of solid bleaching agent (g) | 100 | 500 | 500 | 500 | 500 | 500 | 500 |
| Coating layer | Sodium formate | Sodium acetate | Sodium propionate | Sodium butyrate | Sodium valerate | Sodium hexanoate | Sodium heptanoate |
| Concentration of coating liquid (mass %) | 25 | 25 | 25 | 25 | 25 | 25 | 25 |
| Spraying amount (g) | 250 | 777 | 777 | 777 | 777 | 777 | 777 |
| Spraying speed (g/min) | 0.5 | 20 | 20 | 20 | 20 | 15 | 18 |
| Yield amount (g) | 136 | 724 | 713 | 681 | 671 | 703 | 705 |
| Yield (%) | 74 | 98 | 97 | 94 | 93 | 98 | 99 |
| Proportion of coating layer (mass %) | 36 | 26 | 25 | 21 | 22 | 25 | 26 |
| Average particle diameter (μm) | 1,026 | 1,188 | 918 | 954 | 907 | 1,954 | 1,911 |
| Aggregation rate (%) | 147 | 170 | 131 | 136 | 130 | 279 | 273 |
| Moisture amount immediately after processing (mass %) | 12 | 6.1 | 5.6 | 4.4 | 3.7 | 3.3 | 2.8 |

TABLE 4

| | Example | | | | | |
|---|---|---|---|---|---|---|
| | 24 | 25 | 26 | 27 | 28 | 29 |
| Apparatus used | SFC-MINI | SFC-MINI | SFC-MINI | SFC-MINI | SFC-MINI | SFC-MINI |
| Type of solid bleaching agent | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate |
| Charging amount of solid bleaching agent (g) | 500 | 500 | 500 | 500 | 500 | 500 |
| Coating layer (inner side) | Sodium benzoate | Sodium benzoate | Sodium benzoate | Sodium benzoate | Sodium benzoate | Sodium benzoate |
| Coating layer (outer side) | Disodium sebacate | Disodium sebacate | Disodium sebacate | Disodium dodecane-dioate | Disodium dodecane-dioate | Disodium dodecane-dioate |
| Concentration of coating liquid at coating inner side (mass %) | 35 | 35 | 35 | 35 | 35 | 35 |

TABLE 4-continued

| | Example | | | | | |
|---|---|---|---|---|---|---|
| | 24 | 25 | 26 | 27 | 28 | 29 |
| Concentration of coating liquid at coating outer side (mass %) | 20 | 20 | 20 | 9.2 | 10 | 10 |
| Spraying amount (inner side) (g) | 335 | 545 | 545 | 336 | 545 | 545 |
| Spraying amount (outer side) (g) | 617 | 305 | 153 | 1,289 | 763 | 382 |
| Spraying speed (inner side) (g/min) | 18 | 18 | 18 | 18 | 17 | 18 |
| Spraying speed (outer side) (g/min) | 18 | 18 | 18 | 18 | 17 | 18 |
| Yield amount (g) | 752 | 768 | 737 | 758 | 781 | 746 |
| Yield (%) | 98 | 99 | 99 | 99 | 99 | 99 |
| Proportion of coating layer (inner side) (mass %) | 19 | 30 | 32 | 23 | 31 | 35 |
| Proportion of coating layer (outer side) (mass %) | 15 | 9.1 | 3.9 | 18 | 4.7 | 1.3 |
| Average particle diameter (μm) | 1,020 | 989 | 1,194 | 751 | 874 | 837 |
| Aggregation rate (%) | 146 | 141 | 171 | 107 | 1.25 | 120 |
| Moisture amount immediately after processing (mass %) | 3.0 | 2.8 | 3.2 | 3.4 | 2.5 | 2.8 |

TABLE 5

| | Example | | | | | |
|---|---|---|---|---|---|---|
| | 30 | 31 | 32 | 33 | 34 | 35 |
| Apparatus used | SFC-MINI | SFC-MINI | SFC-MINI | SFC-MINI | SFC-MINI | SFC-MINI |
| Type of solid bleaching agent | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate |
| Charging amount of solid bleaching agent (g) | 500 | 500 | 500 | 500 | 500 | 500 |
| Coating layer, first component | Sodium benzoate | Sodium benzoate | Sodium benzoate | Sodium benzoate | Sodium benzoate | Sodium benzoate |
| Coating layer, second component | Disodium sebacate | Disodium sebacate | Disodium sebacate | Disodium dodecanedioate | Disodium dodecanedioate | Disodium dodecanedioate |
| Concentration of coating liquid at coating (mass %) | 12 | 22 | 27 | 8.5 | 15 | 21 |
| Top: first component concentration | 12 | 7 | 4.4 | 8.5 | 5.8 | 4.1 |
| Bottom: second component concentration | | | | | | |
| Spraying amount (g) | 970 | 850 | 698 | 1,391 | 1,308 | 923 |
| Spraying speed (g/min) | 17 | 18 | 18 | 18 | 18 | 18 |
| Yield amount (g) | 742 | 768 | 733 | 758 | 790 | 747 |
| Yield (%) | 98 | 99 | 99 | 99 | 99 | 99 |
| Proportion of coating layer (first component) (mass %) | 19 | 31 | 36 | 20 | 36 | 30 |
| Proportion of coating layer (second component) (mass %) | 16 | 7.7 | 4.4 | 14 | 4.5 | 1.0 |
| Average particle diameter (μm) | 955 | 964 | 817 | 750 | 888 | 959 |
| Aggregation rate (%) | 136 | 138 | 117 | 107 | 127 | 137 |
| Moisture amount immediately after processing (mass %) | 3.5 | 3.0 | 2.8 | 4.3 | 3.8 | 3.3 |

TABLE 6

| | Example | |
|---|---|---|
| | 36 | 37 |
| Apparatus used | SFC-MINI | SFC-MINI |
| Type of solid bleaching agent | Sodium dichloro-isocyanurate | Sodium dichloro-isocyanurate |
| Charging amount of solid bleaching agent (g) | 500 | 500 |
| Coating layer (inner side) | Sodium benzoate | Sodium benzoate |
| Coating layer (outer side) | Sodium octanoate | Sodium decanoate |
| Concentration of coating liquid at coating inner side (mass %) | 35 | 35 |
| Concentration of coating liquid at coating outer side (mass %) | 25 | 25 |
| Spraying amount (inner side) (g) | 521 | 540 |
| Spraying amount (outer side) (g) | 202 | 188 |
| Spraying speed (inner side) (g/min) | 18 | 18 |
| Spraying speed (outer side) (g/min) | 16 | 15 |
| Yield amount (g) | 725 | 759 |
| Yield (%) | 97 | 100 |
| Proportion of coating layer (inner side) (mass %) | 33 | 35 |
| Proportion of coating layer (outer side) (mass %) | 1.3 | 0.9 |
| Average particle diamete (μm) | 904 | 895 |
| Aggregation rate (%) | 129 | 128 |
| Moisture amount immediately after processing (mass %) | 1.9 | 2.0 |

TABLE 7

| | Example | |
|---|---|---|
| | 38 | 39 |
| Apparatus used | SFC-MINI | SFC-MINI |
| Type of solid bleaching agent | Sodium dichloro-isocyanurate | Sodium dichloro-isocyanurate |
| Charging amount of solid bleaching agent (g) | 500 | 500 |
| Coating layer, first component | Sodium benzoate | Sodium benzoate |
| Coating layer, second component | Sodium octanoate | Sodium decanoate |
| Concentration of coating liquid at coating (mass %) | | |
| Top: first component concentration | 33 | 25 |
| Bottom: second component concentration | 6.7 | 5 |
| Spraying amount (g) | 588 | 749 |
| Spraying speed (g/min) | 17 | 15 |
| Yield amount (g) | 736 | 691 |
| Yield (%) | 98 | 94 |
| Proportion of coating layer (first component) (mass %) | 31 | 30 |
| Proportion of coating layer (second component) (mass %) | 1.4 | 0.9 |
| Average particle diameter (μm) | 812 | 895 |
| Aggregation rate (%) | 116 | 128 |
| Moisture amount immediately after processing (mass %) | 2.6 | 1.8 |

TABLE 8

| | Comparative Example | | | | | | | |
|---|---|---|---|---|---|---|---|---|
| | 1 | 2 | 3 | 4 | 5 | 6 | 7 | 8 |
| Apparatus used | SFC-MINI | DPZ-01 | DPZ-01 | DPZ-01 | SFC-MINI | SFC-MINI | DPZ-01 | DPZ-01 |
| Type of solid bleaching agent | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate |
| Charging amount of solid bleaching agent (g) | 500 | 100 | 100 | 100 | 500 | 500 | 100 | 100 |
| Coating layer | Sodium lauryl sulfate | Sodium alkyl benzene sulfonate | Sodium α-olefin sulfonate | Hydroxy-propyl cellulose | Sodium laurate | Sodium octanoate | Sodium hydrogen carbonate | Sodium sulfate |
| Concentration of coating liquid (mass %) | 25 | 7 | 25 | 10 | 20 | 20 | 7 | 10 |
| Spraying amount (g) | 622 | 975 | 270 | 1,200 | 665 | 950 | 955 | 400 |
| Spraying speed (g/min) | 16 | 0.5 | 0.5 | 0.5 | 15 | 15 | 0.5 | 0.5 |
| Yield amount (g) | 697 | 147 | 131 | 130 | 643 | 645 | 131 | 111 |
| Yield (%) | 97 | 78 | 71 | 55 | 96 | 91 | 69 | 74 |
| Proportion of coating layer (mass %) | 21 | 36 | 29 | 33 | 16 | 25 | 32 | 12 |
| Average particle diameter (μm) | 1,423 | 1,422 | 965 | 1,468 | 1,763 | 2,065 | 966 | 881 |
| Aggregation rate (%) | 203 | 203 | 138 | 210 | 252 | 295 | 138 | 126 |
| Moisture amount immediately after processing (mass %) | 8.7 | 11 | 9.7 | 7.0 | 5.3 | 2.7 | 12 | 6.6 |

TABLE 9

| | Comparative Example | | | |
|---|---|---|---|---|
| | 9 | 10 | 11 | 12 |
| Apparatus used | DPZ-01 | DPZ-01 | DPZ-01 | DPZ-01 |
| Type of solid bleaching agent | Sodium dichloro-isocyanurate | Sodium dichloro-isocyanurate | Sodium dichloro-isocyanurate | Sodium dichloro-isocyanurate |
| Charging amount of solid bleaching agent (g) | 100 | 200 | 70 | 61 |

TABLE 9-continued

| | Comparative Example | | | |
|---|---|---|---|---|
| | 9 | 10 | 11 | 12 |
| Coating layer | Myristic acid | Sodium lauryl sulfate and silicone antifoaming agent | Paraffin wax and fine zeolite | Stearyl alcohol and fine zeolite |
| Concentration of coating liquid (mass %) | 22 | 29 | No solvent | No solvent |
| Spraying amount or addition amount (g) | 370 | 620 | 12 g of paraffin wax 18 g of fine zeolite | 13 g of stcaryl alcohol 26 g of fine zeolite |
| Spraying speed (g/min) | 0.5 | 0.5 | — | — |
| Yield amount (g) | 144 | 309 | 98 | 95 |
| Yield (%) | 79 | 78 | 98 | 95 |
| Proportion of coating layer (mass %) | 33 | 34 | 29 | 35 |
| Average particle diameter (μm) | 1,024 | 1,131 | 899 | 1,191 |
| Aggregation rate (%) | 146 | 162 | 128 | 170 |
| Moisture amount immediately after processing (mass %) | — | 4.1 | — | — |

TABLE 10

| | | Example | | | | | | |
|---|---|---|---|---|---|---|---|---|
| | | 1 | 2 | 3 | 4 | 5 | 6 | 7 |
| Type of solid bleaching agent | | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate |
| Coating layer | | Sodium benzoate | Sodium benzoate | Sodium para-t-butylbenzoate | Disodium ortho-phthalate | Disodium meta-phthalate | Disodium para-phthalate | Trisodium trimellitate |
| Stability test 1: before coating, effective chlorine retention rate (%) | | 12 | | | | | | |
| Stability test 1: after coating, effective chlorine retention rate (%) | | 60 | 70 | 61 | 29 | 51 | 42 | 47 |
| Foaming amount (ml) | | 0 | 0 | 0 | 0 | 0 | 0 | 0 |
| Solubility (presence or absence of residues) | 0.2 mass % | Absent | Absent | Absent | Absent | Absent | Absent | Absent |
| | 5 mass % | Absent | Absent | Absent | Absent | Absent | Absent | Absent |
| Evaluation result | Stability | A | A | A | A | A | A | A |
| | Foamability | A | A | A | A | A | A | A |
| | Solubility | A | A | A | A | A | A | A |

TABLE 11

| | | Example | | | | |
|---|---|---|---|---|---|---|
| | | 8 | 9 | 10 | 11 | 12 |
| Type of solid bleaching agent | | Sodium dichloro-isocyanurate | Sodium dichloro-isocyanurate | Sodium dichloro-isocyanurate | Sodium dichloro-isocyanurate | Sodium dichloro-isocyanurate |
| Coating layer | | Disodium succinate | Disodium glutarate | Disodium adipate | Disodium pimelate | Disodium suberate |
| Stability test 1: before coating, effective chlorine retention rate (%) | | 12 | | | | |
| Stability test 1: after coating, effective chlorine retention rate (%) | | 24 | 23 | 33 | 17 | 68 |
| Foaming amount (ml) | | 0 | 0 | 0 | 0 | 0 |
| Solubility | 0.2 mass % | Absent | Absent | Absent | Absent | Absent |

TABLE 11-continued

| | | | | | | |
|---|---|---|---|---|---|---|
| (presence or absence of residues) | 5 mass % | Absent | Absent | Absent | Absent | Absent |
| Evaluation result | Stability | A | A | A | A | A |
| | Foamability | A | A | A | A | A |
| | Solubility | A | A | A | A | A |

| | | Example | | | |
|---|---|---|---|---|---|
| | | 13 | 14 | 15 | 16 |
| Type of solid bleaching agent | | Sodium dichloro-isocyanurate | Sodium dichloro-isocyanurate | Sodium dichloro-isocyanurate | Sodium dichloro-isocyanurate |
| Coating layer | | Disodium azelate | Disodium sebacate | Disodium dodecane-dioate | Disodium tetradecane-dioate |
| Stability test 1: before coating, effective chlorine retention rate (%) | | 12 | | | |
| Stability test 1: after coating, effective chlorine retention rate (%) | | 35 | 63 | 20 | 26 |
| Foaming amount (ml) | | 0 | 0 | 0 | 0 |
| Solubility (presence or absence of residues) | 0.2 mass % | Absent | Absent | Absent | Absent |
| | 5 mass % | Absent | Absent | Absent | Absent |
| Evaluation result | Stability | A | A | A | A |
| | Foamability | A | A | A | A |
| | Solubility | A | A | A | A |

TABLE 12

| | | Example | | | | | | |
|---|---|---|---|---|---|---|---|---|
| | | 17 | 18 | 19 | 20 | 21 | 22 | 23 |
| Type of solid bleaching agent | | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate |
| Coating layer | | Sodium formate | Sodium acetate | Sodium propionate | Sodium butyrate | Sodium valerate | Sodium hexanoate | Sodium heptanoate |
| Stability test 1: before coating, effective chlorine retention rate (%) | | 12 | | | | | | |
| Stability test 1: after coating, effective chlorine retention rate (%) | | 23 | 17 | 14 | 20 | 21 | 44 | 68 |
| Foaming amount (ml) | | 0 | 0 | 0 | 0 | 0 | 0 | 0 |
| Solubility (presence or absence of residues) | 0.2 mass % | Absent | Absent | Absent | Absent | Absent | Absent | Absent |
| | 5 mass % | Absent | Absent | Absent | Absent | Absent | Absent | Absent |
| Evaluation result | Stability | A | A | A | A | A | A | A |
| | Foamability | A | A | A | A | A | A | A |
| | Solubility | A | A | A | A | A | A | A |

TABLE 13

| | Example | | | | | |
|---|---|---|---|---|---|---|
| | 24 | 25 | 26 | 27 | 28 | 29 |
| Type of solid bleaching agent | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate |
| Coating layer (inner side) | Sodium benzoate | Sodium benzoate | Sodium benzoate | Sodium benzoate | Sodium benzoate | Sodium benzoate |
| Coating layer (outer side) | Disodium sebacate | Disodium sebacate | Disodium sebacate | Disodium dodecanedioate | Disodium dodecanedioate | Disodium dodecanedioate |
| Stability test 1: before coating, effective chlorine retention rate (%) | 12 | | | | | |

TABLE 13-continued

| | | Example | | | | | |
|---|---|---|---|---|---|---|---|
| | | 24 | 25 | 26 | 27 | 28 | 29 |
| Stability test 1: after coating, effective chlorine retention rate (%) | | 46 | 30 | 41 | 64 | 60 | 72 |
| Foaming amount (ml) | | 0 | 0 | 0 | 0 | 0 | 0 |
| Solubility (presence or absence of residues) | 0.2 mass % | Absent | Absent | Absent | Absent | Absent | Absent |
| | 5 mass % | Absent | Absent | Absent | Absent | Absent | Absent |
| Evaluation result | Stability | A | A | A | A | A | A |
| | Foamability | A | A | A | A | A | A |
| | Solubility | A | A | A | A | A | A |

TABLE 14

| | | Example | | | | | |
|---|---|---|---|---|---|---|---|
| | | 30 | 31 | 32 | 33 | 34 | 35 |
| Type of solid bleaching agent | | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate |
| Coating layer (first component) | | Sodium benzoate | Sodium benzoate | Sodium benzoate | Sodium benzoate | Sodium benzoate | Sodium benzoate |
| Coating layer (second component) | | Disodium sebacate | Disodium sebacate | Disodium sebacate | Disodium dodecanedioate | Disodium dodecanedioate | Disodium dodecanedioate |
| Stability test 1: before coating, effective chlorine retention rate (%) | | 12 | | | | | |
| Stability test 1: after coating, effective chlorine retention rate (%) | | 22 | 61 | 30 | 66 | 57 | 41 |
| Foaming amount (ml) | | 0 | 0 | 0 | 0 | 0 | 0 |
| Solubility (presence or absence of residues) | 0.2 mass % | Absent | Absent | Absent | Absent | Absent | Absent |
| | 5 mass % | Absent | Absent | Absent | Absent | Absent | Absent |
| Evaluation result | Stability | A | A | A | A | A | A |
| | Foamability | A | A | A | A | A | A |
| | Solubility | A | A | A | A | A | A |

TABLE 15

| | | Example | |
|---|---|---|---|
| | | 36 | 37 |
| Type of solid bleaching agent | | Sodium dichloro-isocyanurate | Sodium dichloro-isocyanurate |
| Coating layer (inner side) | | Sodium benzoate | Sodium benzoate |
| Coating layer (outer side) | | Sodium octanoate | Sodium decanoate |
| Stability test 1: before coating, effective chlorine retention rate (%) | | 12 | |
| Stability test 1: after coating, effective chlorine retention rate (%) | | 43 | 39 |
| Foaming amount (ml) | | 0 | 0 |
| Solubility (presence or absence of residues) | 0.2 mass % | Absent | Absent |
| | 5 mass % | Absent | Absent |
| Evaluation result | Stability | A | A |
| | Foamability | A | A |
| | Solubility | A | A |

TABLE 16

| | | Example | |
|---|---|---|---|
| | | 38 | 39 |
| Type of solid bleaching agent | | Sodium dichloro-isocyanurate | Sodium dichloro-isocyanurate |
| Coating layer (first component) | | Sodium benzoate | Sodium benzoate |
| Coating layer (second component) | | Sodium octanoate | Sodium decanoate |
| Stability test 1: before coating, effective chlorine retention rate (%) | | 12 | |
| Stability test 1: after coating, effective chlorine retention rate (%) | | 57 | 32 |
| Foaming amount (ml) | | 0 | 0 |
| Solubility (presence or absence of residues) | 0.2 mass % | Absent | Absent |
| | 5 mass % | Absent | Absent |
| Evaluation result | Stability | A | A |
| | Foamability | A | A |
| | Solubility | A | A |

TABLE 17

| | | Comparative Example | | | | | | | |
|---|---|---|---|---|---|---|---|---|---|
| | | 1 | 2 | 3 | 4 | 5 | 6 | 7 | 8 |
| Type of solid bleaching agent | | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate | Sodium dichloro-isocyanurate |
| Coating layer | | Sodium lauryl sulfate | Sodium alkyl benzene sulfonate | Sodium α-olefin sulfonate | Hydroxy-propyl cellulose | Sodium laurate | Sodium octanoate | Sodium hydrogen carbonate | Sodium sulfate |
| Stability test 1: before coating, effective chlorine retention rate (%) | | 12 | | | | | | | |
| Stability test 1: after coating, effective chlorine retention rate (%) | | 46 | 49 | 48 | 65 | 74 | 64 | 1 | 3 |
| Foaming amount (ml) | | 80< | 80< | 80< | 5 | 30 | 0 | 0 | 0 |
| Solubility (presence or absence of residues) | 0.2 mass % | Absent | Absent | Absent | Present | Present | Absent | Absent | Absent |
| | 5 mass % | Absent | Absent | Present | Present | Present | Present | Absent | Absent |
| Evaluation result | Stability | A | A | A | A | A | A | B | B |
| | Foamability | C | C | C | B | C | A | A | A |
| | Solubility | A | A | B | C | C | B | A | A |

TABLE 18

| | | Comparative Example | | | |
|---|---|---|---|---|---|
| | | 9 | 10 | 11 | 12 |
| Type of solid bleaching agent | | Sodium dichloro-isocyanurate | Sodium dichloro-isocyanurate | Sodium dichloro-isocyanurate | Sodium dichloro-isocyanurate |
| Coating layer | | Myristic acid | Sodium lauryl sulfate and antifoaming agent | Paraffin wax and fine zeolite | Stearyl alcohol and fine zeolite |
| Stability test 1: before coating, effective chlorine retention rate (%) | | 12 | | | |
| Stability test 1: after coating, effective chlorine retention rate (%) | | 49 | 64 | 63 | 66 |
| Foaming amount (ml) | | 5 | 10 | 0 | 1 |
| Solubility (presence or absence of residues) | 0.2 mass % | Present | Present | Present | Present |
| | 5 mass % | Present | Present | Present | Present |
| Evaluation result | Stability | A | A | A | A |
| | Foamability | B | B | A | B |
| | Solubility | C | C | C | C |

Examples 40 to 42

In the same manner as in Example 1 except for the conditions described in Table 19, samples of a solid bleaching agent-containing material having a coating layer were prepared by using a halogenated hydantoin mixture, peroxysulfuric acid-sulfuric acid-penta-potassium salt, and trichloroisocyanuric acid, respectively, as a solid bleaching agent, and by using sodium benzoate for the coating layer in the same manner as in Example 1. The concentration (% by mass) of the coating liquid, moisture content (% by mass) of each of the prepared samples and proportion (% by mass) of the coating layer were as shown in Table 19. For each sample after drying at 110° C. for 1.5 hours, in the same manner as in the cases of Example 1 and Example 2, the stability test 1, foamability test and solubility test were carried out. The results were as shown in Table 20. For the stability test 1 of Example 41, the effective oxygen retention rate was calculated instead of the effective chlorine retention rate. In addition, for the solubility tests of Examples 40 and 42, only the test at 0.2% by mass was performed. In each of these Examples, although the type of the solid bleaching agent was different, the compound of the coating layer was the same as in Example 1, and the proportion (% by mass) of the coating layer was also equal to or less than that in Example 1. Thus, it was obvious that no residues derived from the coating layer are generated even in the case of the solubility test at 5% by mass, and therefore the solubility was judged as A. The halogenated hydantoin mixture and the trichloroisocyanuric acid have solubilities of 0.54 g and 1.2 g, respectively, with respect to water of 100 g. Even such solid bleaching agents having a low solubility in water can be used.

TABLE 19

| | Example | | |
|---|---|---|---|
| | 40 | 41 | 42 |
| Apparatus used | DPZ-01 | DPZ-01 | DPZ-01 |
| Type of solid bleaching agent | Halogenated hydantoin mixture | Peroxy-sulfuric acid-sulfuric acid-penta-potassium salt | Trichloro-isocyanuric acid |
| Charging amount of solid bleaching agent (g) | 100 | 100 | 100 |
| Coating layer | Sodium benzoate | Sodium benzoate | Sodium benzoate |
| Concentration of coating liquid (% by mass) | 35 | 35 | 35 |
| Spraying amount (g) | 160 | 140 | 285 |
| Spraying speed (g/min) | 1 | 1 | 1 |
| Yield amount (g) | 123 | 115 | 149 |
| Yield (%) | 77 | 76 | 74 |
| Proportion of coating layer (% by mass) | 28 | 27 | 36 |
| Average particle diameter (μm) | 1,015 | 931 | 1,024 |
| Aggregation rate (%) | 145 | 133 | 146 |
| Moisture amount immediately after processing (% by mass) | 2.9 | 1.1 | 1.1 |

TABLE 20

| | | Example | | |
|---|---|---|---|---|
| | | 40 | 41 | 42 |
| Type of solid bleaching agent | | Halogenated hydantoin mixture | Peroxysulfuric acid-sulfuric acid-penta-potassium salt | Trichloro-isocyanuric acid |
| Coating layer | | Sodium benzoate | Sodium benzoate benzoate | Sodium |
| Stability test 1: before coating, effective chlorine retention rate or effective oxygen retention rate (%) | | 15 | 3 | 30 |
| Stability test 1: after coating, effective chlorine retention rate or effective oxygen retention rate (%) | | 39 | 26 | 78 |
| Foaming amount (ml) | | 0 | 0 | 0 |
| Solubility (presence or absence of residues) | 0.2 mass % | Absent | Absent | Absent |
| | 5 mass % | — | Absent | — |
| Evaluation result | Stability | A | A | A |
| | Foamability | A | A | A |
| | Solubility | A | A | A |

Examples 43 to 45

In the same manner as in Example 1, except that sodium percarbonate was used as a solid bleaching agent, the conditions described in Table 21 were employed, heating was not carried out by leaving the setting of a heater temperature OFF, and samples were allowed to stand for 1 hour in an oven at 40° C. after completion of spraying, samples of a solid bleaching agent-containing material having a coating layer were prepared by using disodium ortho-phthalate, sodium benzoate, and sodium 1-naphthoate, respectively, for the coating layer. The concentration (% by mass) of the coating liquid was as shown in Table 21. The proportion of the coating layer in each of Examples 43 to 45 was measured by an absorbance method. That is, the respective calibration curves were prepared by measuring absorbance at 280 nm by using aqueous solutions in which disodium ortho-phthalate, sodium benzoate and sodium 1-naphthoate had been dissolved to predetermined concentrations, respectively. The solid bleaching agent-containing materials having a coating layer prepared in Examples 43 to 45 were dissolved in water, and the disodium ortho-phthalate, sodium benzoate and sodium 1-naphthoate in the aqueous solutions were determined by quantification by using the prepared calibration curves, respectively. Hereinafter, the quantifying method will be described in more detail.

Disodium ortho-phthalate aqueous solutions were prepared so as to be 0.662 (g/L), 0.331 (g/L), 0.166 (g/L), and 0.0828 (g/L), respectively. Each of the aqueous solutions was put in a quartz cell having a size of 12.4 mm×12.4 mm×45 mm (optical path length of 10 mm) and set in a cell holder of an ultraviolet-visible spectrophotometer UV-1800 (manufactured by Shimadzu Corporation). When measurements were performed by using distilled water as a background, the absorbances at 280 nm were 1.85, 0.956, 0.490, and 0.252, respectively. Therefore, a relationship between the concentration of disodium ortho-phthalate and the absorbance was represented by concentration (g/L)=0.3624×absorbance−0.0114. Next, the solid bleaching agent-containing material having a coating layer prepared in Example 43 was dissolved to be 1.088 (g/L), and an absorbance was similarly measured by using, as a background, an aqueous solution of sodium percarbonate (PC-2) that had been adjusted to have the same effective oxygen content. As a result, the absorbance was 0.881, from which it was found that disodium ortho-phthalate was 0.308 (g/L). That is, 0.308 g in 1.088 g was the disodium ortho-phthalate used in the coating layer, and the proportion of the coating layer was determined to be 28% by mass according to Expression 6.

In the same manner, sodium benzoate aqueous solutions were prepared to have concentrations of 0.582 (g/L), 0.291 (g/L), 0.146 (g/L), and 0.0728 (g/L), respectively. Absorbances thereof at 280 nm were measured and were 0.889, 0.463, 0.238, and 0.122, respectively. Therefore, a relationship between the concentration of sodium benzoate and the absorbance was represented by concentration (g/L) =0.6655×absorbance−0.012. The sample prepared in Example 44 was dissolved to be 1.112 (g/L), and an absorbance was similarly measured by using, as a background, an aqueous solution of sodium percarbonate (PC-2) that had been adjusted to have the same effective oxygen content, and found to be 0.481, from which it was found that sodium benzoate was 0.308 (g/L). That is, 0.308 g in 1.112 g was the sodium benzoate used in the coating layer, and the proportion of the coating layer was determined to be 28% by mass according to Expression 6.

In the same manner, sodium 1-naphthoate aqueous solutions were prepared to have concentrations of 0.0504 (g/L), 0.0252 (g/L), 0.0126 (g/L), 0.00630 (g/L), and 0.00315 (g/L), respectively. Absorbances thereof at 280 nm were measured and were 1.54, 0.773, 0.387, 0.194, and 0.0980, respectively. Therefore, a relationship between the concentration of sodium 1-naphthoate and the absorbance was represented by concentration (g/L)=0.0327×absorbance−0.000006. When the sample prepared in Example 45 was dissolved in water so as to be 0.1098 (g/L), an absorbance thereof was 0.844, from which it was found that sodium 1-naphthoate was 0.0279 g/L. The proportion of the coating layer was determined to be 25% by mass according to Expression 6.

For the samples prepared in Examples 43 to 45, in the same manner as in the cases of Example 1 and Example 2, the stability test 1, foamability test and solubility test were carried out. The results were as shown in Table 22. For the stability test 1 of Examples 43 to 45, the effective oxygen retention rate was calculated instead of the effective chlorine retention rate.

TABLE 21

| | Example | | |
|---|---|---|---|
| | 43 | 44 | 45 |
| Apparatus used | DPZ-01 | DPZ-01 | DPZ-01 |
| Type of solid bleaching agent | Sodium percarbonate | Sodium percarbonate | Sodium percarbonate |
| Charging amount of solid bleaching agent (g) | 100 | 100 | 100 |
| Coating layer | Disodium ortho-phthalate | Sodium benzoate | Sodium 1-naphthoate |
| Concentration of coating liquid (mass %) | 25 | 36 | 25 |
| Spraying amount (g) | 245 | 175 | 145 |
| Spraying speed (g/min) | 1 | 1 | 1 |
| Yield amount (g) | 139 | 128 | 130 |
| Yield (%) | 79 | 78 | 91 |
| Proportion of coating layer (mass %) | 28 | 28 | 25 |
| Average particle diameter (μm) | 1,001 | 830 | 1,054 |
| Aggregation rate (%) | 143 | 119 | 151 |
| Moisture amount immediately after processing (mass %) | 7.9 | 1.0 | 4.7 |

TABLE 22

| | | Example | | |
|---|---|---|---|---|
| | | 43 | 44 | 45 |
| Type of solid bleaching agent | | Sodium percarbonate | Sodium percarbonate | Sodium percarbonate |
| Coating layer | | Disodium ortho-phthalate | Sodium benzoate | Sodium 1-naphthoate |
| Stability test 1: before coating, effective oxygen retention rate (%) | | | 25 | |
| Stability test 1: after coating, effective oxygen retention rate (%) | | 36 | 65 | 35 |
| Foaming amount (ml) | | 0 | 0 | 0 |
| Solubility (presence or absence of residues) | 0.2 mass % | Absent | Absent | Absent |
| | 5 mass % | Absent | Absent | Absent |
| Evaluation result | Stability | A | A | A |
| | Foamability | A | A | A |
| | Solubility | A | A | A |

Stability Test 2 (Long-Term Storage Test)

Examples 46 to 55

In a stainless steel beaker were charged 5 g of distilled water and 3 g of potassium carbonate, and the potassium carbonate was dissolved. Next, the aqueous solution was stirred while heating the beaker with a hot water bath, and, at a time point where the liquid temperature reached 80° C., 50 g of sodium metasilicate pentahydrate, 30 g of trisodium nitrilotriacetate monohydrate, 1 g of olefin-anhydrous sodium maleate copolymer, and 10.5 g of sodium sulfate were added thereto and stirring was continued. Thereafter, the temperature of the hot water bath was decreased to 65° C. while stirring the slurried composition, 0.5 g of sodium metasilicate was further added, stirring was performed for 30 minutes, and then cooled, to thereby obtain a pasty detergent composition. Next, solid bleaching agent-containing materials having a coating layer which had been prepared in Examples 2, 3, 5, 6, 7, 13, 14, 20, 21, and 22, and uncoated sodium dichloroisocyanurate were accurately weighed within a range of from 0.10 to 0.13 g, masses thereof were recorded up to 4 decimal places, and put in cylindrical polypropylene cups (inner diameter of 25 mm, height of 22 mm) with the top being opened. The pasty detergent composition heated to 60° C. was accurately weighed within a range of from 2.5 to 3.5 g, a mass thereof was recorded up to 3 decimal places, and added so as to be superimposed on the solid bleaching agent-containing material or sodium dichloroisocyanurate, to thereby prepare detergent compositions containing the solid bleaching agent-containing material or the solid bleaching agent. The cups in which the detergent composition containing the solid bleaching agent-containing material or the solid bleaching agent was put was placed side by side in a resin vat, and the entire vat was put in a bag made of low-density polyethylene having a thickness of 0.1 mm. An opening of the bag was hermetically sealed by heat sealing, and stored for 1 month in a thermo-hygrostat with a temperature of 40° C. and a relative humidity (RH) of 75% being maintained. One month later, the entire amount of the detergent composition containing the solid bleaching agent-containing material or the solid bleaching agent in the cup was dissolved in about 100 ml of distilled water, and the effective chlorine retention rate was evaluated from the effective chlorine content in the same manner as in the case of the stability test 1.

In the case of using sodium dichloroisocyanurate before coating, no effective chlorine was detected after 1 month, and the effective chlorine retention rate was 0%. The effective chlorine retention rates of the solid bleaching agent-containing materials having a coating layer prepared in Examples 2, 3, 5, 6, 7, 13, 14, 20, 21, and 22 were as shown in Table 23, and even after a long-term storage, a high effective chlorine retention rate was exhibited. In the stability test 2, since the effective chlorine retention rate of sodium dichloroisocyanurate before coating, which served as a reference, was 0%, the effective chlorine retention rate of each sample would not be lower than the effective chlorine retention rate of the sodium dichloroisocyanurate before coating. Therefore, evaluation criteria were different from that in the case of the stability test 1. The case where the effective chlorine retention rate was less than 5% was evaluated as failed which is denoted by B, because an effect of improving stability was hardly recognized. The case where the effective chlorine retention rate was 5% or more was evaluated as pass which is denoted by A, because an effect of improving stability was recognized. The case where the effective chlorine retention rate was 70% or more was evaluated as particularly excellent among passes, which is denoted by S.

TABLE 23

| | Example | | | | |
|---|---|---|---|---|---|
| | 46 | 47 | 48 | 49 | 50 |
| Type of solid bleaching agent | Sodium dichloro-isocyanurate | Sodium dichloro-isocyanurate | Sodium dichloro-isocyanurate | Sodium dichloro-isocyanurate | Sodium dichloro-isocyanurate |
| Coating layer | Sodium benzoate | Sodium para-t-butyl-benzoate | Disodium meta-phthalate | Disodium para-phthalate | Trisodium trimellitate |
| Example in which solid bleaching agent-containing material having coating layer was prepared | Example 2 | Example 3 | Example 5 | Example 6 | Example 7 |
| Stability test 2: before coating, effective chlorine retention rate (%) | | | 0 | | |
| Stability test 2: after coating, effective chlorine retention rate (%) | 100 | 99 | 84 | 81 | 92 |
| Evaluation result, stability | S | S | S | S | S |

| | Example | | | | |
|---|---|---|---|---|---|
| | 51 | 52 | 53 | 54 | 55 |
| Type of solid bleaching agent | Sodium dichloro-isocyanurate | Sodium dichloro-isocyanurate | Sodium dichloro-isocyanurate | Sodium dichloro-isocyanurate | Sodium dichloro-isocyanurate |
| Coating layer | Disodium azelate | Disodium sebacate | Sodium butyrate | Sodium valerate | Sodium hexanoate |
| Example in which solid bleaching agent-containing material having coating layer was prepared | Example 13 | Example 14 | Example 20 | Example 21 | Example 22 |
| Stability test 2: before coating, effective chlorine retention rate (%) | | | 0 | | |
| Stability test 2: after coating, effective chlorine retention rate (%) | 11 | 11 | 12 | 8 | 50 |

TABLE 23-continued

| | | | | | |
|---|---|---|---|---|---|
| Evaluation result, stability | A | A | A | A | A |

Examples 56 to 63

With respect to the solid bleaching agent-containing materials having a coating layer prepared in Examples 25, 28, 36, and 37, and the solid bleaching agent-containing materials having a coating layer prepared in Examples 31, 35, 38, and 39, in the same manner as in Examples 46 to 55, the stability test 2 was carried out. The results were as shown in Tables 24 and 25.

TABLE 24

| | Example | | | |
|---|---|---|---|---|
| | 56 | 57 | 58 | 59 |
| Type of solid bleaching agent | Sodium dichloro-isocyanurate | Sodium dichloro-isocyanurate | Sodium dichloro-isocyanurate | Sodium dichloro-isocyanurate |
| Coating layer (inner side) | Sodium benzoate | Sodium benzoate | Sodium benzoate | Sodium benzoate |
| Coating layer (outer side) | Disodium sebacate | Disodium dodecane-dioate | Sodium octanoate | Sodium decanoate |
| Example in which solid bleaching agent-containing material having coating layer was prepared | Example 25 | Example 28 | Example 36 | Example 37 |
| Stability test 2: before coating, effective chlorine retention rate (%) | | | 0 | |
| Stability test 2: after coating, effective chlorine retention rate (%) | 88 | 77 | 90 | 95 |
| Evaluation result, stability | S | S | S | S |

TABLE 25

| | Example | | | |
|---|---|---|---|---|
| | 60 | 61 | 62 | 63 |
| Type of solid bleaching agent | Sodium dichloro-isocyanurate | Sodium dichloro-isocyanurate | Sodium dichloro-isocyanurate | Sodium dichloro-isocyanurate |
| Coating layer (first component) | Sodium benzoate | Sodium benzoate | Sodium benzoate | Sodium benzoate |
| Coating layer (second component) | Disodium sebacate | Disodium dodecane-dioate | Sodium octanoate | Sodium decanoate |
| Example in which solid bleaching agent-containing material having coating layer was prepared | Example 31 | Example 35 | Example 38 | Example 39 |
| Stability test 2: before coating, effective chlorine retention rate (%) | | | 0 | |
| Stability test 2: after coating, effective chlorine retention rate (%) | 90 | 95 | 95 | 100 |
| Evaluation result, stability | S | S | S | S |

Comparative Examples 13 to 16

With respect to the solid bleaching agent-containing materials having a coating layer prepared in Comparative Examples 3, 7, 8, and 11, in the same manner as in Examples 56 to 63, the stability test 2 was carried out. The results were as shown in Table 26. In Comparative Example 13 (using the solid bleaching agent-containing material prepared in Comparative Example 3) and in Comparative Example 16 (using the solid bleaching agent-containing material prepared in Comparative Example 11), even in the stability test 2, the effective chlorine retention rates thereof were 1% and 2%, respectively, which are results of a lower stability than the cases in the stability test 1. In Comparative Example 14 (using the solid bleaching agent-containing material prepared in Comparative Example 7) and in Comparative Example 15 (using the solid bleaching agent-containing material prepared in Comparative Example 8), even in the stability test 2, no improvement in effective chlorine retention rate was recognized similar to the cases in the stability test 1. Even from the results of the stability test 2, it was found that the solid bleaching agent-containing material having a coating layer of the present invention has a remarkable effect.

TABLE 26

| | Comparative Example | | | |
|---|---|---|---|---|
| | 13 | 14 | 15 | 16 |
| Type of solid bleaching agent | Sodium dichloro-isocyanurate | Sodium dichloro-isocyanurate | Sodium dichloro-isocyanurate | Sodium dichloro-isocyanurate |
| Coating layer | Sodium α-olefin sulfonate | Sodium hydrogen carbonate | Sodium sulfate | Paraffin wax and fine zeolite |
| Comparative Example in which solid bleaching agent-containing material having coating layer was prepared | Comparative Example 3 | Comparative Example 7 | Comparative Example 8 | Comparative Example 11 |
| Stability test 2: before coating, effective chlorine retention rate (%) | | | 0 | |
| Stability test 2: after coating, effective chlorine retention rate (%) | 1 | 0 | 0 | 2 |
| Evaluation result, stability | B | B | B | B |

Stability Test 3 (Abrasion Test)

Examples 64 to 72

In order to evaluate a stability in the case where a physical impact was applied to the solid bleaching agent-containing materials having a coating layer prepared in Examples 1, 25, 28, 31, 35, 36, 37, 38, and 39, an abrasion test was carried out by using a tablet abrasion tester (manufactured by Toyama Sangyo Co., Ltd.). This tablet abrasion tester is composed of a plastic drum container having an inner diameter of about 286 mm and a depth of about 38 mm, and an electric part rotating the drum container in a vertical direction. Inside the drum container, a partition plate is provided so that a test sample in the container is lifted up to about 157 mm in height and falls each time when the drum container makes one rotation. Such a tablet abrasion tester is readily available. With respect to the tablet abrasion tester, reference can be made to reference information in the Japanese Pharmacopoeia, Seventeenth Edition.

In the drum container of the tablet abrasion tester were charged 5 g of the solid bleaching agent-containing material having a coating layer and 5 g of spherical glass beads having a diameter of about 5 mm, and the drum container was rotated 1,000 revolutions by an electric motor in a vertical direction at a rotational speed in 25 revolutions per minute. After completion of 1,000 revolutions, the glass beads were removed from the solid bleaching agent-containing material having a coating layer, and a stability was evaluated in the same manner as in the stability test 2, except that a storage period in the thermo-hygrostat with a temperature of 40° C. and a relative humidity of 75% RH was set to 3 months. The case where the effective chlorine retention rate was less than 5% was evaluated as failed which is denoted by B because an effect of improving stability was hardly recognized. The case where the effective chlorine retention rate was 5% or more and less than 10% was evaluated as pass which is denoted by A, because an effect of improving stability was recognized. The case where the effective chlorine retention rate was 10% or more was evaluated as particularly excellent among passes, which is denoted by S. The results were as shown in Table 27. It was found that a high stability is maintained even after the solid bleaching agent-containing material having a coating layer has been impacted due to collision with the glass beads in the rotating drum.

Comparative Example 17

With respect to the solid bleaching agent-containing material which had been prepared under the same conditions as in Comparative Example 1 and in which the coating layer was composed of sodium lauryl sulfate, in the same manner as in Examples 64 to 72, the stability test 3 was carried out. The results were as shown in Table 27. It was considered that the sample prepared in Comparative Example 1 could not maintain an effective chlorine retention rate, because the solid bleaching agent-containing material having a coating layer was impacted and abraded due to collision with the glass beads in the rotating drum.

TABLE 27

| | Example | | | | |
|---|---|---|---|---|---|
| | 64 | 65 | 66 | 67 | 68 |
| Type of solid bleaching agent | Sodium dichloro-isocyanurate | Sodium dichloro-isocyanurate | Sodium dichloro-isocyanurate | Sodium dichloro-isocyanurate | Sodium dichloro-isocyanurate |
| Coating layer | Sodium benzoate | Sodium benzoate (inner) Disodium sebacate (outer) | Sodium benzoate (inner) Disodium dodecane-dioate (outer) | Sodium benzoate (first) Disodium sebacate (second) | Sodium benzoate (first) Disodium dodecane-dioate (second) |

TABLE 27-continued

| Example in which solid bleaching agent-containing material having coating layer was prepared | Example 1 | Example 25 | Example 28 | Example 31 | Example 35 |
|---|---|---|---|---|---|
| Stability test 3: before coating, effective chlorine retention rate (%) | | | 0 | | |
| Stability test 3: after coating, effective chlorine retention rate (%) | 36 | 32 | 39 | 63 | 24 |
| Evaluation result, stability | S | S | S | S | S |

| | Example | | | | Comp. Ex. |
|---|---|---|---|---|---|
| | 69 | 70 | 71 | 72 | 17 |
| Type of solid bleaching agent | Sodium dichloro-isocyanurate | Sodium dichloro-isocyanurate | Sodium dichloro-isocyanurate | Sodium dichloro-isocyanurate | Sodium dichloro-isocyanurate |
| Coating layer | Sodium benzoate (inner) Sodium octanoate (outer) | Sodium benzoate (inner) Sodium decanoate outer | Sodium benzoate (first) Sodium octanoate (second) | Sodium benzoate (first) Sodium decanoate (second) | Sodium lauryl sulfate |
| Example in which solid bleaching agent-containing material having coating layer was prepared | Example 36 | Example 37 | Example 38 | Example 39 | Comp. Ex. 1 |
| Stability test 3: before coating, effective chlorine retention rate (%) | | | 0 | | 0 |
| Stability test 3: after coating, effective chlorine retention rate (%) | 19 | 49 | 11 | 35 | 0 |
| Evaluation result, stability | S | S | S | S | B |

Stability Test 4 (Storage with Stirring Test)

Example 73

In a polypropylene resin container with lid (volume of 120 ml, bottom surface inside diameter of 52 mm) were charged 21 g of distilled water, 13 g of sodium hydroxide, 5 g of sodium metasilicate nonahydrate, 20 g of trisodium nitrilotriacetate monohydrate, 1 g of diisobutylene-maleic acid copolymer, 10 g of sodium carbonate, 30 g of sodium hydroxide, and 2 g of the solid bleaching agent-containing material prepared in Example 1 in this order, and the mixture was stirred for 2 hours at a revolution rate of 300 rpm by using a Teflon stirring blade (stirring blade diameter of 40 mm) while heating in a water bath so that an inside of the resin container became 40° C., to thereby prepare a detergent composition. The entire amount of the detergent composition after stirring was dissolved in 3 L of distilled water and an effective chlorine content was evaluated. In addition, the lid of the container in which a mixture after stirring which had been prepared separately by the same procedure was hermetically sealed and allowed to stand at room temperature for 2 weeks. In the same manner, the effective chlorine content was evaluated after 2 weeks. Based on the theoretical effective chlorine content calculated from the charged amount, the stability after stirring was evaluated. The results were as shown in Table 28. Even after 2 hours of stirring in the detergent composition, an effective chlorine retention rate of 60% or more of the charged chlorine agent was exhibited, and the effective chlorine content was not decreased even after further 2 weeks.

Comparative Example 18

A detergent formulation was prepared by using sodium dichloroisocyanurate (without a coating layer) as a solid bleaching agent in place of the solid bleaching agent-containing material having a coating layer, and the stability test 4 was carried out in the same manner as in Example 73. The results were as shown in Table 28. At the time point after stirring for 2 hours, no effective chlorine was detected.

TABLE 28

| | Example 73 | Comparative Example 18 |
|---|---|---|
| Type of solid bleaching agent | Sodium dichloroisocyanurate | Sodium dichloroisocyanurate |
| Coating layer | Sodium benzoate | Absent |
| Example in which solid bleaching agent-containing material having coating layer was prepared | Example 1 | — |
| Effective chlorine retention rate after 2 hours of stirring (%) | 68 | 0 |
| Effective chlorine retention rate after further 2 weeks of storage (%) | 68 | 0 |

Bleaching Test

Example 74

The detergent composition prepared in Example 73 in which the solid bleaching agent-containing material having a coating layer was blended was dissolved in distilled water so as to be 0.2% by mass, to thereby prepare a detergent aqueous solution, and a pH and an effective chlorine concentration (mg/L) thereof were measured. The results were as shown in Table 29. Furthermore, 770 ml of the detergent aqueous solution was put in a 1 L volume beaker, and a cotton cloth (STC EMPA 167, manufactured by Nippon Materials Co., Ltd.) dyed with 5 cm×5 cm black tea was soaked so that half of the cloth area was immersed and allowed to stand at 23° C. for 30 minutes. The cotton cloth taken out after 30 minutes was dried at a normal temperature and then a whiteness was evaluated by using a whiteness meter (digital whiteness meter TC-6D, manufactured by Tokyo Denshoku Co., Ltd.) with respect to each of a whiteness of the part having been immersed in the detergent aqueous solution and a whiteness of the part having not been immersed in the detergent aqueous solution. The results were as shown in Table 29. The whiteness of the part having been immersed in the detergent aqueous solution reflects bleaching effects by the detergent aqueous solution, and the whiteness of the part having not been immersed reflects an original color of the cotton cloth. Thus, it can be considered that the detergent aqueous solution exhibits a higher bleaching effect as a difference in whiteness between the respective parts is larger. The aqueous solution of the detergent composition prepared in Example 73 had particularly high bleaching power. In the whiteness, a larger numerical value means that a color of an object is closer to white. Regarding the whiteness, reference can be made to JIS Z 8715 (Japanese Industrial Standard "Color Display Method: Whiteness") or JIS Z 8722 (Japan Industrial Standard "Color Measurement Method: Reflectance and Transparent Object Color"). Also, with respect to a cotton cloth to be tested, one which has a different dyeing method or material may be appropriately selected and used. In addition, in the case where the whiteness meter cannot be used, whiteness may be visually evaluated.

Comparative Examples 19 to 22

In the same manner as in Example 74, a whiteness of the cotton cloth was evaluated with respect to four cases of: a detergent aqueous solution (Comparative Example 19) prepared by dissolving the detergent composition prepared in Comparative Example 18 in distilled water so as to have a concentration of 0.2% by mass; a 0.2% by mass aqueous solution (Comparative Example 20) of a detergent composition prepared in the same manner as in Comparative Example 18 except that a solid bleaching agent was not added; an aqueous solution (Comparative Example 21) in which only sodium dichloroisocyanurate was dissolved as a solid bleaching agent (one in which an effective chlorine concentration was adjusted to be the same as in Example 74); and only distilled water (Comparative Example 22). The results were as shown in Table 29. Since no effective chlorine was detected in the detergent aqueous solution prepared from the detergent composition prepared in Comparative Example 18, it was considered that the solid bleaching agent (sodium dichloroisocyanurate) was inactivated during mixing. In addition, the detergent composition (Comparative Example 20) prepared without adding the solid bleaching agent and the detergent composition (Comparative Example 19) prepared with Comparative Example 18 showed about the same level of bleaching effect. Thus, even though a solid bleaching agent is blended, it was considered that in the case where the solid bleaching agent is inactivated in the detergent composition, it did not contribute to bleaching effects.

TABLE 29

| | Example 74 | Comparative Example 19 | Comparative Example 20 | Comparative Example 21 | Comparative Example 22 |
|---|---|---|---|---|---|
| Detergent composition | Prepared in Example 73 | Prepared in Comparative Example 18 | Prepared in Comparative Example 18 (without solid bleaching agent) | Solid bleaching agent alone | Distilled water alone |
| Detergent concentration (% by mass) | 0.2 | 0.2 | 0.2 | — | — |
| pH | 12.5 | 12.5 | 12.5 | 7.4 | 7.0 |
| Effective chlorine concentration of detergent aqueous solution (mg/L) | 27 | 0 | 0 | 27 | 0 |

TABLE 29-continued

| | Example 74 | Comparative Example 19 | Comparative Example 20 | Comparative Example 21 | Comparative Example 22 |
|---|---|---|---|---|---|
| Whiteness of part having not been immersed in detergent aqueous solution | 23.6 | 24.5 | 23.3 | 26.9 | 29.0 |
| Whiteness of part having been immersed in detergent aqueous solution | 46.9 | 38.3 | 39.5 | 36.0 | 29.0 |

As such, the detergent composition prepared by using the solid bleaching agent-containing material having a coating layer of the present invention can retain effective chlorine even after stirring and mixing, so that the effective chlorine can synergistically act with other components of the detergent composition. Thus, the detergent composition was considered to have a high bleaching effect, as compared with either of the case of a detergent composition alone which does not contain a solid bleaching agent or the case of a bleaching agent alone which had been modulated to the same effective chlorine concentration.

These results show that the solid bleaching agent-containing material having a coating layer of the present invention can exhibit a good stability and can retain effects of washing, bleaching and sterilization even in the case of being blended with detergent components to form a detergent composition. In addition, the solid bleaching agent-containing material of the present invention has an effect of generating no or an extremely small amount of foaming or residues, and therefore can be used for a wide range of applications. The fact that not only effects of high solubility in water and of generating no or an extremely small amount of foaming or residues are exhibited, but also a good stability is exhibited over a long period of time even in a detergent composition in which water is present is a particularly remarkable effect. In addition, the fact that the solid bleaching agent-containing material of the present invention maintains a high stability even after a physical impact is given in advance or after being subjected to a step such as stirring and mixing as the detergent composition is a particularly remarkable effect. These effects are considered to be derived from the fact that the coating layer of the solid bleaching agent-containing material protects the solid bleaching agent by suppressing the reaction between the solid bleaching agent and other components, and does not allow it to be a cause of foaming or residues.

While the present invention has been described in detail and with reference to specific embodiments, it will be apparent to those skilled in the art that various changes and modifications can be made without departing from the spirit and scope of the present invention. The present application is based on Japanese Patent Application (No. 2016-086619) filed on Apr. 22, 2016, the contents of which are incorporated herein by reference.

INDUSTRIAL APPLICABILITY

The solid bleaching agent-containing material having a coating layer provided by the present invention is protected from factors causing deterioration, deactivation or decomposition of the bleaching agent, and has effects of improving stability and of generating no foaming or residues even in the case of being blended with various compounds used as detergent components to form a detergent composition. Accordingly, suitable applications are found in fields of washing of drain pipes or water storage parts of kitchens, bathrooms, washrooms, toilets, and the like, bleaching, sterilization or washing of dishes, utensils and the like, washing of clothes and the like, maintenance management of daily water such as for a bath and a pool, and the like.

The invention claimed is:

1. A solid bleaching agent-containing material, comprising: a first layer containing a solid bleaching agent; and a second layer formed of a coating layer, wherein the first layer is a core and the second layer surrounds the first layer;

wherein the second layer is present in the solid bleaching agent-containing material in an amount of 5% by mass or more;

wherein the coating layer comprises one or more selected from the group consisting of alkali metal salts of aromatic carboxylic acids, alkali metal salts of acyclic dicarboxylic acids, alkali metal salts of acyclic monocarboxylic acids having a carbon number of from 1 to 7, and mixtures thereof; and wherein the solid bleaching agent is one or more halogen bleaching agents selected from the group consisting of halogenated isocyanuric acids, alkali metal salts of halogenated isocyanuric acids, hydrates of alkali metal salts of halogenated isocyanuric acids, halogenated hydantoins, and mixtures thereof.

2. The solid bleaching agent-containing material according to claim 1, wherein the alkali metal salt of an aromatic carboxylic acid is one or more selected from the group consisting of alkali metal salts of benzoic acid, ortho-phthalic acid, meta-phthalic acid, para-phthalic acid, trimellitic acid, and para-t-butylbenzoic acid, and mixtures thereof.

3. The solid bleaching agent-containing material according to claim 1, wherein the alkali metal salt of an acyclic dicarboxylic acid is one or more selected from the group consisting of alkali metal salts of succinic acid, glutaric acid, adipic acid, suberic acid, azelaic acid, sebacic acid, undecanedioic acid, dodecanedioic acid, and tetradecanedioic acid, and mixtures thereof.

4. The solid bleaching agent-containing material according to claim 1, wherein the alkali metal salt of an acyclic monocarboxylic acid having a carbon number of from 1 to 7 is one or more selected from the group consisting of alkali metal salts of formic acid, acetic acid, propionic acid, butyric acid, valeric acid, hexanoic acid, and heptanoic acid, and mixtures thereof.

5. A detergent composition, comprising: the solid bleaching agent-containing material as described in claim 1, and one or more metal ion scavengers selected from the group consisting of aminocarboxylic acid salts, hydrates of aminocarboxylic acid salts, hydroxyaminocarboxylic acid salts, hydrates of hydroxyaminocarboxylic acid salts, tripolyphosphates, phosphonocarboxylic acids, alkali metal salts of phosphonocarboxylic acids, hydrates of phosphonocarboxylic acids, polyacrylic acid, alkali metal salts of polyacrylic acid, glutamic acid diacetate, hydrate of glutamic acid diacetate, and mixtures thereof.

6. A detergent composition, comprising: the solid bleaching agent-containing material as described in claim 1, and one or more nonionic surfactants.

7. A detergent composition, comprising: the solid bleaching agent-containing material as described in claim 1, and one or more alkali metal salts selected from the group consisting of alkali metal hydroxides, alkali metal silicates, alkali metal carbonates, alkali metal phosphates, and mixtures thereof.

* * * * *